US011124398B2

(12) United States Patent
Moore

(10) Patent No.: US 11,124,398 B2
(45) Date of Patent: Sep. 21, 2021

(54) TILT-SAFE, HIGH-CAPACITY LIFT DEVICE

(71) Applicant: Moore Tire Equipment LLC, Coalville, UT (US)

(72) Inventor: Jason Thomas Moore, Coalville, UT (US)

(73) Assignee: Gaither Tool Company, Inc., Jacksonville, IL (US)

( * ) Notice: Subject to any disclaimer, the term of this patent is extended or adjusted under 35 U.S.C. 154(b) by 0 days.

(21) Appl. No.: 16/286,026

(22) Filed: Feb. 26, 2019

(65) Prior Publication Data

US 2019/0292029 A1 Sep. 26, 2019

Related U.S. Application Data

(63) Continuation-in-part of application No. 15/260,167, filed on Sep. 8, 2016, now Pat. No. 10,214,399.

(51) Int. Cl.
*B66F 3/36* (2006.01)

(52) U.S. Cl.
CPC ..... *B66F 3/36* (2013.01); *B66F 2700/052* (2013.01); *B66F 2700/055* (2013.01)

(58) Field of Classification Search
CPC . B66F 3/36; B66F 2700/052; B66F 2700/055
USPC .... 254/93 H, 89 H, 93 R, 98, 100, 101, 102, 254/103, 133 R, 134
See application file for complete search history.

(56) References Cited

U.S. PATENT DOCUMENTS 292,702 A 1/1884 Somes
444,915 A 1/1891 Cavender
462,327 A 11/1891 Petersen
548,137 A 10/1895 Pewthers
808,535 A 12/1905 Gardisky
908,210 A 12/1908 Crystal
1,004,741 A 10/1911 Burkholder
1,419,544 A 6/1922 Benedetti
1,784,116 A 12/1930 Shevlin
1,945,910 A 2/1934 Nilson
1,990,004 A 2/1935 Shannon
2,495,092 A 1/1950 Cox et al.
2,618,122 A 11/1952 Gratzmuller
2,702,988 A 3/1955 Rhoads et al.
2,706,052 A 4/1955 Trautman et al.
3,027,140 A * 3/1962 Holzbach ..... E04G 25/065 254/98
3,220,699 A 11/1965 Falk
3,317,187 A 5/1967 Steppon
4,330,104 A 5/1982 Klok
4,731,505 A 3/1988 Crenshaw et al.
(Continued)

*Primary Examiner* — Lee D Wilson
*Assistant Examiner* — Alberto Saenz
(74) *Attorney, Agent, or Firm* — QPatents

(57) ABSTRACT

A lifting device with a head cavity in the lifting member shaped to accept a removable lifting head. The head cavity in the lifting device—e.g., the piston of a bottle jack—may be provided with threads, or may have the threads removed. A yoke fitted on the lifting head provides registration, horizontal restraint, or both against a lifted object, component, or surface to prevent sliding off the lifting head while in use. In a smooth-walled-shaft embodiment, a set of risers (spacers, adjusters, trims, or shims) serves to adjust an extension height of the shaft, elevating the lifting head with respect to the piston prior to beginning to lift the hydraulic piston.

14 Claims, 14 Drawing Sheets

(56) References Cited

U.S. PATENT DOCUMENTS

| | | | | |
|---|---|---|---|---|
| 4,736,505 | A * | 4/1988 | Vanbeber | B25B 27/304 254/10.5 |
| 4,899,985 | A | 2/1990 | Good | |
| 5,372,353 | A | 12/1994 | West | |
| 6,860,470 | B2 * | 3/2005 | Schaefer | B66F 3/247 254/133 R |
| 6,902,148 | B1 * | 6/2005 | Spencer | B66F 3/30 254/2 B |
| 7,207,548 | B1 * | 4/2007 | Howe | B66F 3/00 254/98 |
| 7,694,940 | B2 * | 4/2010 | Yueh | B66F 3/42 254/93 H |
| 8,348,237 | B2 * | 1/2013 | Shi | B66F 3/245 254/93 R |
| 8,662,476 | B2 | 3/2014 | Weddle | |
| 9,670,040 | B2 | 6/2017 | Martinez Martinez | |
| 2009/0159861 | A1 | 6/2009 | Gray | |

* cited by examiner

TILT-SAFE, HIGH-CAPACITY LIFT DEVICE

CROSS-REFERENCE TO RELATED APPLICATIONS

The present application claims priority from, and incorporates by reference in its entirety, U.S. patent application Ser. No. 15/260,167 filed Sep. 8, 2016.

BACKGROUND

Field of the Invention

This invention relates to hydraulic jacks and, more particularly, to novel systems and methods for hydraulic "bottle jacks" load rated for heavy vehicles under which they are used.

Description of Related Art

Bottle jacks are small, portable, self-contained systems. Relying on hydraulic oil, they operate on certain principles of fluid mechanics. Being hand-portable, they cannot have all the mechanisms, protections, conveniences, wheels, bearing widths or lengths, size, stabilization, visibility and so forth possible for rolling floor jacks (also called trolley jacks) common in commercial repair shops.

At the top of the piston is typically a head. That head is a problem. The relatively small cross sectional area of a head is almost universally inadequate. It is typically dictated by the size of the shaft inside the lift piston. Frictional engagement is poor due to metal-to-metal contact. Moreover, a bottle jack on or near a roadway has an uncontrolled supporting surface on which it may tip, slide, or otherwise shift dangerously. The instabilities of the head and the base against their respective environments combine to be dangerous.

For example, a bottle jack poorly placed or shifting during use creates a dangerous level of force and a weighty projectile. Forces may literally "kick out" a jack at a velocity and momentum (mass×velocity) sufficient to cause serious injury or death to a user in the vicinity It would be an advance in the art to develop a system to stabilize a jack in the uncontrolled environment of roadside assistance. Novel and non-obvious improvements may benefit by sacrificing convenience of integral jacks for more useful and more readily adaptability on the roadside. Certain "consumer safety" benefits and restrictions may need to be set aside in favor of improved capabilities for a professional mechanic providing roadside assistance distant from the controlled environment of a workshop or garage.

BRIEF SUMMARY OF THE INVENTION

In view of the foregoing, in accordance with the invention as embodied and broadly described herein, a method and apparatus are disclosed in one embodiment of the present invention as including a bottle set in a base provided with a conventional hydraulic pump, hand lever, and release valve. However, the main lift piston may be modified to have no internal threads. In alternative embodiments, it may still keep internal threads. Air power may be substituted for hydraulics, used as an example here. Powered air or oil supplies may replace hand levers to drive pistons.

In certain embodiments, the shaft extending from the main lift piston may have a smooth wall sized to retro-fit within the already threaded inside diameter of a threaded main lift piston. The shaft in the piston may be fitted to a smooth inside wall of the main lift piston. In yet another embodiment, the shaft may not match piston threads yet still be threaded and engaging a collar nut at the top of the piston rather than the threaded interior of the main lift piston. Some features may be used with conventional shafts threaded into conventional pistons.

Multiple heads, sometimes called lifting heads, each formed integrally and in fixed, solid relation to their shafts may be provided in a set of exchangeable accessories. Heads may include a conventional round head, with its conventional crossed grooves. However, in an accessory in accordance with the invention, the entire shaft is typically removable from within the lift piston. In this way, other alternative accessories may be placed into the main lift piston to replace the original head and shaft.

Integration results in bottle jacks that are self contained. The pump is typically built right into the base, or at least its principal cylinder for its piston is. The other components are fitted therein and thereagainst. The bottle contains the main cylinder, the oil, and the main lift piston. That lift piston fits inside the bottle and the cylinder. The lever may be a separate article, but may simply be a tire iron that is a standard lug wrench used also to operate as a lever. Thus, outside of the lever, the packaging is very compact and self contained. The release for a bottle jack may be a valve formed in a cavity built into the casting of the base. That valve, by a simple turning may be opened a selected amount to allow oil to escape from the main lift cylinder beneath the main lift piston, thus providing a steady descent of the lift piston. Accordingly, the user does not have to deal with large forces. A comparatively modest rate of lift is available and a controlled, modest rate of descent is provided.

For bottle jacks used in accordance with the invention, the jack height and the distance between the ground or other supporting surface below the jack and the component being lifted (at its lifting point or location over the head) will often not match very closely. Blocks or shims may be placed under a jack. Sections of wooden boards may serve as shims. In addition, a central shaft on which the head is mounted may or may not be threaded on its outside surface. A thread may or may not be formed on the inside surface of the cylinder to receive the shaft threads.

A user may shim up the base of a jack with boards or blocks, of constant thickness or tapered to some safe (presumably) height. An operator or user may turn the head its shaft or with a shaft (if fixed thereto). The shaft may extend within the main piston in order to adjust the head up to a position of contact. Contact must be made with a lift point (location) on the component (e.g., a spring. "U" bolt, bracket axle, etc.) against which the force will be applied so the load will be lifted. The process of lifting the jack on its supporting blocking and extending the shaft under the head within the lift piston provides flexibility in the starting height of a bottle jack. Thus, the entire stroke of extension of the principal piston is available for lifting.

In certain embodiments, a new head may have a shape that provides a yoke having a flat or curved bottom, main lifting surface. At either end in a horizontal direction along that main lifting surface may be a restraint or retainer. The retainer may appear like a leg of a U. The head is shaped something like a U with the main lift surface providing the base of the U and the retainers or legs of the U rising upward away therefrom. The main lift surface is sized to fit various components, such as an axle, a spring leaf, or the like.

The legs of the U may be of different lengths. For example, one side may extend higher than the other (e.g., one end of the head may have a leg or a retainer that extends higher than that of the other end). This will permit lifting or extending the shaft a distance or height before moving the jack under the component to which lift forces will be applied. By having one leg higher, the lower and leading leg or retainer may pass under the lifted component. The trailing leg or retainer extends higher and therefore will not past under, but registers against the lifted component. This brings the jack to a stop, and into registration for proper lifting.

The shaft under such a head may be threaded or smooth. If smooth, the shaft may be provided with shims or risers. A user may withdraw the shaft from within the main lift piston, slide one or more shims or risers onto the shaft, and drop the shaft back into the lift piston. This permits setting a lift height bias or height offset or starting height at an arbitrary distance desired and appropriate for the lifted object.

A system of risers may include risers having a nominal height of one unit, two units, and four units. A unit may be a centimeter, an inch, or some other appropriate height. Thus, the head height with respect to the main bottle and base of the jack may be offset by one inch (unit of height) with a single riser, two units by a two-units-of-height riser. Three units require a combination of the one unit and two unit risers. Four units require the use of a four-unit-high riser. Five units require a combination of the four and one unit risers. Six units require a combination of the four unit and two unit risers. And seven units require a combination of the one, two, and three unit risers.

Such a kit of accessories may be placed in a case. They would not work conveniently if integrated to always be connected. Their modularity dictates that they cannot all be installed as part of the jack at all times. A redesign of the method of use and the architecture of the jack are in order to comply with the needs addressed by a system in accordance with the invention.

In an alternative embodiment, the inner surface of the main lift piston may be threaded and the outer surface of the shaft may be threaded. The head in accordance with the invention may be rotated to rotate the shaft, thus causing relative displacement of the mating threads between the shaft and the piston.

However, in another alternative embodiment, the shaft may be still threaded, but smaller in diameter such as to not mate with the threads of the piston. It may fit within a smooth wall of a piston. An advantage to a shaft having threads is that another shim or riser may simply be a set ring. A set ring may match the threads of the shaft, and be threaded upward or downward in order to provide a preset displacement of the shaft with respect to the piston.

The height of the shaft within the main lift piston need have nothing to do with an engagement of threads between the shaft and the piston. Rather, the offset distance is controlled by the position of the set ring threaded down along the threads of the shaft, and engaging the top surface or annulus of the main lift piston. One may see where mutual threads between the shaft and piston, smooth shaft and threaded piston, threaded shaft and disengaged threaded piston, smooth shaft in threaded piston, or smooth shaft in smooth piston are all combinations that may be configured to work in accordance with the invention.

Moreover, the head shapes may vary. For example, in one embodiment, the shape of the yoke that becomes a head in accordance with the invention may have a circular internal diameter or simply a curved inside lift surface. The lift surface may extend from the tip of the retainer or leg on one end to the tip of the retainer on the other end in a smooth arcuate curve. The curve may be circular, some other curve shape, or the like. This tends to center any load near the bottom most region of the curve, but may accommodate shallower curves than circular, or the like.

In yet another embodiment of an apparatus and method in accordance with the invention, the head may be constituted by an annulus extending some height, typically sufficient height to accommodate an open end of a "U" bolt. For example, a shaft of any of the varieties described hereinabove may be formed integrally with a head that is a right circular cylinder, hollow in the center. The upper edge or annulus of this cylinder may press against the nut attached to "U" bolt. The hollowed cavity within this tubular shape is sized to receive the free end of the "U" bolt extending out beyond the nut.

In an apparatus and method in accordance with the invention, a heavy load may be lifted in a Y-shaped yoke or in a "cup" type of cylindrical head. These may be adjusted by threading between a shaft and lift piston. Threading may adjust between a set ring and a threaded shaft fitted into an inner cavity of a main lift piston. Initial height may be offset or set by an assembly of risers arranged in combination to provide an initial offset in the relative height between the head and the main bottle jack.

Conventional blocks (or even wedge-shaped shims) may still be used under the jack. Thus, the system and apparatus in accordance with the invention may be used by retrofitting shafts and heads in accordance with the invention into conventional jacks from which the main shaft has been removed. Meanwhile, a jack may actually be fabricated in accordance with the invention as an entirely new system.

One embodiment of an apparatus may include a base, a containment vessel sealed to the base, a cylinder within the containment vessel, a piston operably engaging the cylinder to move with respect thereto in response to hydraulic pressure, a pump connected between the cylinder and the containment vessel, a system of valves controlling movement of a hydraulic fluid between the containment vessel, the pump, and the cylinder, and a shaft fitted to ride within the piston and selectively removable therefrom without tools. To this may be added or included a head monolithically formed with the shaft to engage a load, the head comprising a lift surface and a retainer, and at least one retainer being disposed horizontally at one extreme dimension of the head to resist lateral movement of the lifted load with respect to the head. The shaft may have an outer surface that is smooth, engaging the piston exclusively for the purpose of horizontal stability, and transferring substantially no vertical force between the smooth wall and the piston.

A set of risers or spacers may be sized to fit against the smooth wall of the shaft to offset vertically the shaft with respect to the piston, and may be sized to have heights that are substantially integral multiples of one another. The head may be constituted by a yoke generally shaped like a 'U' and having two legs extending above a lift surface, which may be flat, curved, cupped, or otherwise shaped. The yoke typically comprises two legs, disposed horizontally opposite one another with respect to the lift surface, one leg being significantly shorter than the other leg. Equal leg lengths may also be used. The shaft and head (principally including the yoke) are integrally formed and sized to fit the shaft within a bottle jack conventionally manufactured, and altered only by removal of a threaded shaft originally manufactured as a part of the jack. A shoulder, on at least one of the shaft and a head integrally formed with the shaft, is sized and shaped to fit against an annular top surface of the main lift piston. In at least some embodiments the load path of force supported by the piston does not pass through the shaft at any point substantially below the shoulder.

A method of lifting a load may begin by providing a bottle jack and a head, the head comprising a yoke integrally secured to a shaft, the shaft being selectively removable without tools from within a piston of the bottle jack, selecting a head, placing the head within the piston, placing the bottle jack beneath the load, registering the yoke under a lift point, and lifting the load may be reversed by conventionally by descending the load, and removing the head from the bottle jack. A set or kit on a service truck may include multiple heads configured to have yokes of different shapes corresponding to lift points on a load to be lifted. The multiple heads may have shapes selected from a 'U' shape having a flat base and legs extending thereabove, a 'U' shape having a continuous surface between opposite extremes of the yoke, a yoke constituted by a cup-shape having a top, annular, lift surface, surrounding a relief region for receiving an unloaded portion of a lifted component, or the like. In one method, a mechanic may obtain a conventional bottle jack, and remove a central shaft from a main lift piston thereof. By fitting a head, comprising a yoke integrally and monolithically formed within a shaft to fit the shaft within the main lift piston and the yoke sized to not enter within the piston, the mechanic (user, operator) is also providing a lift surface against which the main lift piston will pass load to the lifted object. Also, remove one may, but need not from inside the main lift piston the set of threads. The yoke should be integrally formed on a shaft to operate as a single, solid, monolithic component, the shaft being sized to fit within the main lift piston snugly but easily movable whether or not threads remain.

One method of manufacturing a jack may include providing a frame sealed to a containment vessel, providing a pump operably connected between the base and the containment vessel, providing a cylinder within the containment vessel, providing a piston operably coupled to travel within the cylinder, operably connecting a system of valves to selectively pass a hydraulic fluid from the containment vessel through the pump to the cylinder at a pressure effective to lift a load supported by the cylinder and to release the hydraulic fluid to pass from the cylinder back to the containment vessel in order to effect retraction of the main piston under the load, and providing a head constituting a yoke secured to a shaft, the shaft sized to selectively install within the piston and remove therefrom without the use of tools. The yoke may be selected to be shaped as one of 'U,' a cup, or a flat. The system may include a set of risers (spacers, adjusters, shims, collars) usable in combination to offset the yoke from the piston prior to extension of the piston.

BRIEF DESCRIPTION OF THE DRAWINGS

The foregoing features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

DETAILED DESCRIPTION OF THE PREFERRED EMBODIMENTS

Figure 1:
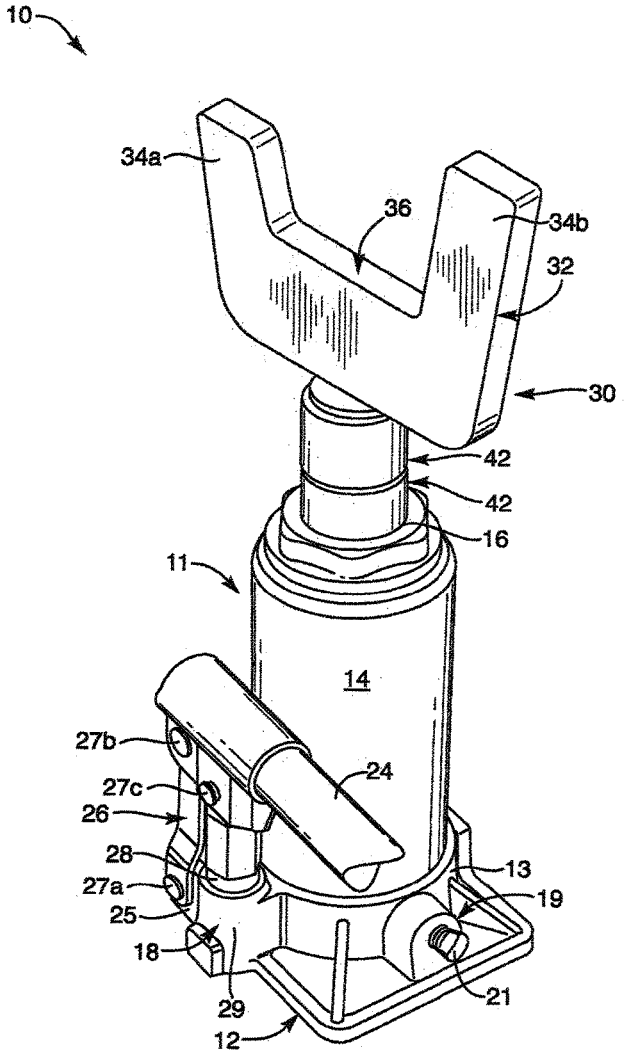
FIG. 1 is a perspective view of one embodiment of a bottle jack equipped with safety accessories in accordance with the invention.

It will be readily understood that the components of the present invention, as generally described and illustrated in the drawings herein, could be arranged and designed in a wide variety of different configurations. Thus, the following more detailed description of the embodiments of the system and method of the present invention, as represented in the drawings, is not intended to limit the scope of the invention, as claimed, but is merely representative of various embodiments of the invention. The illustrated embodiments of the invention will be best understood by reference to the drawings, wherein like parts are designated by like numerals throughout. A reference numeral followed by a letter is simply an instance of the item identified by the number. It is proper herein to use the reference number alone or with a trailing letter, and every trailing letter need not be referenced in the text, even if appearing in a figure.

The various embodiments are described in terms of being used with bottle jacks, for the sake of clarity and brevity. However, the various embodiments may be used with other types of lifting devices, including for example, a bottle jack, a multiple post vehicle lift (e.g., a two post vehicle lift, a four post vehicle lift, etc.), a farm jack, a bumper jack, a screw jack, a trailer jack, a floor jack (sometimes called a garage jack or a service jack, e.g., with rollers), a forklift jack, a pallet jack, a lift bag lifting device, an electric jack, jack stands, and a toe jack, and other like types of lifting devices known to those of ordinary skill in the art. The various lifting devices may be powered by one or more of hydraulic fluid, by compressed air or other gases, by a mechanical lever operated by a user, by an electric motor, or other sources of power or forces.

Referring to FIGS. 1-12, systems 10 in accordance with the invention must avoid or overcome several problems. At one level, they operate on certain well known principles of fluid mechanics. For example, a bottle jack 11 in accordance with the invention typically contains a base 12 formed by casting or forging the base and fitting and sealing into it a containment vessel, the bottle 14. A small manual pump 18 is typically formed by fitting a piston 20 into a cylinder 16 machined into the casting 12 that is the base 12. Air-powered jacks 11 may be adapted to receive compressed air. The base 12, at its widest dimension, is typically approximately twice as wide as the containment vessel 14. Some implementations may call for increased stability due to vibrations, horizontal forces or unlevel surfaces. In such implementations embodiments are provided with a the base 12 may be up to four times as wide as the containment vessel 14, or even up to ten times as wide as the containment vessel 14 or more.

The piston pump 18, along with an associated assembly of valving, such as check valves. It pumps oil from the main containment vessel 14 or bottle 14 into a central cylinder 16 that runs along the axial center of the bottle 14. In that central cylinder 16 may be a piston 20 constituted by a movable, cylindrical member fitted with a seal near the bottom thereof that seals against oil leakage out from the region between the seal on the piston 20 and the containing cylinder 16.

In operation, a hand lever 24 is pumped by a user resulting in a leverage advantage on the pump cylinder 29. The pump piston 28, as it pumps up and down within the pump cylinder 29, pumps oil from within the bottle 14 or containment vessel 14 into the main cylinder 16 beneath the main piston 20 or lift piston 20. The result is hydraulic pressure lifting the main piston 20. A system of check valves prevents any backflow from under the piston 20 toward the pump 18.

At the top of the piston 20, and fitted into it, is typically a head 30, sometimes called a lifting head. That head 30 is specially designed to avoid a traditional problem. A typical conventional head is a machined part that is usually a circular piece having a suitable thickness on the order of about one centimeter thick or more depending on the rating (load capacity) of the bottle jack 11. Typically that head has formed in it a cross of two grooves orthogonal to one another, or some other texturized shape cut into the head.

The top surface of that head, such as the cross of two grooves orthogonally oriented with respect to one another on the top of that head, in typical conventional systems, constitutes the entire gripping capacity of the head to support any component being lifted. Notwithstanding there exists some amount of friction between the top head surface and a matching surface on a component against which the head lifts, the only lateral force other than plain frictional resistance against sliding between the component and the head is that cross of twin grooves or other teeth or texturing provided on the head.

The result of the small cross sectional area of a head is inadequate. Frictional engagement is poor due to the fact that it is formed of a metal such as steel. Also, the components against which the jack fits may not be flat, may not be level, or both. Moreover, they may move, change their orientation, or both while being lifted. All these are a danger.

It is not uncommon to have a vehicle, machine, article, or other load weighing hundreds, thousands, or even tens of thousands of pounds. For example, the gross vehicle weight rating on large over-the-road trucks may reach 80,000 pounds, or 40 tons. A significant fraction of that load is supported by each axle, and a portion of each axle is supported by each set of wheels on that axle.

A flat tire or damaged component may require halting a truck, placing a bottle jack on the ground, roadway, or other surface thereunder, and lifting a set of wheels. Of course, the wheels cannot be accessed directly. Accordingly, one end of the axle must be lifted.

Some typical locations available as possible lift points may be a portion of the axle, which may be round, rounded, or rectangular, thus presenting a rounded, circular, or flat surface. Also, a truck may be lifted by a lifting spring. Although not recommended, because it can damage the threads, a jack may lift against "U" bolt securing an axle to its spring assembly.

"U" bolts typically extend over a set of springs, with the base of the "U" with each leg of the "U" extending downward to capture each leaf of the spring assembly. A bracket typically secures below an axle, by the "U" bolts passing through the bracket. A nut on each free end of the "U" bolt secures the bracket plate to the "U" bolt. Thus, the axle is captured between the bracket and the springs by the "U" bolt.

A bottle jack poorly placed or shifting during use creates a danger. Suspension systems often move an axle in an arc, such that the lift point above a jack moves as it rises. An engagement that shifts or is shifted at its base along a supporting surface may be important. An engagement that keeps a lift point engaged with the jack, regardless would be valuable. An engagement forceful enough to preferentially keep the head engaged even if the base must slide or even tip may also be valuable.

A flying jack results when eccentric forces may literally "kick out" a jack when friction fails to keep the base fixed or the head of the jack secured with respect to the lift point on the component against which the jack is applying force to lift.

The energy released is sufficient to cause serious injury or death if the jack strikes a user who is in the vicinity or operating the jack. Moreover, the jacks may be damaged and many jacks show damage to the head from such slips and falls.

The substantial loading on a jack with the ground supporting the base of the jack, and a substantial load on top of the jack, particularly when loading (force and location) on the base or on the head becomes displaced off a central axis of the lifting shaft.

The problem is not trivial. Besides alignment, a dynamic problem with bottle jacks is that as an axle lifts, it does not lift exactly vertically. A swinging or radius of motion may exist, causing an axle or other lift point to swing out of alignment. This may be laterally (left or right), longitudinally (forward or backward), as well as upward on a radius. Any combination thereof may also occur.

This effect will mean that as a truck lifts, the position of the lift point over the jack changes. It moves in an are centered on the contact point of the radius, such as a swing arm or other pivot about which a lift point may move. This may be one end of a spring shackle, an arm, a tandem axle connector, an opposite tire that remains grounded, or the like.

The problem does not exist with steel leaf or coil spring systems alone. Air bag types of springs have similar problems, and typically are coupled on even shorter swing arms causing a greater arcuate displacement. Any of the foregoing may result in shifting a load or even tipping a bottle jack, off its original vertical axis. Meanwhile, this occurs as the main piston extends from the bottle jack, lengthening the distance from a supporting surface (e.g., ground, pavement, roadway, roadside, etc.) as the axle lifts to raise a tire for changing.

Accordingly, a system is described hereinbelow to stabilize a jack and keep it in its proper location. It provides lateral, longitudinal, or both forces in its engagement between a head of a bottle jack and the component against which the bottle jack will operate or lift, and be urged horizontally as well.

It still provides the leverage, still maintains a comparatively compact size and envelope (set of outer dimensions), and is a compact kit. Maintaining such a system as a self contained, always integral unit may not be realistic. Adaptability often sacrifices integral connection of components.

Thus, it is one of the novel and non-obvious improvements to develop a system that sacrifices convenience of integral jacks for adaptability in the hands of a professional. For example, extension of the shaft directly supporting the head is an advantage. Moreover, providing the foregoing systems in a compact format, easily carried in a vehicle remote from a garage, such as a service vehicle is valuable. Such a system best serves, as it can be handled easily, often with a single hand, by an individual technician (mechanic) sent out to assist a disabled truck right at the highway side.

Referring to FIG. 1, while referring generally to FIGS. 1 through 12, a system 10 and method in accordance with the invention may involve a bottle jack 11. A bottle jack 11 may actually form a significant portion of the operating mechanism of the system 10. In certain illustrated embodiments, the bottle jack 11 may be completely conventional. In other embodiments, the bottle jack 11 may actually be newly manufactured to include different components and material properties than conventional bottle jacks 11. Meanwhile, a system 10 in accordance with the invention may operate to improve function and safety of a bottle jack 11, as described hereinabove.

The bottle jack 11 may include a base 12, typically formed by casting or forging, followed by machining to receive certain other components. For example, the base 12 may be machined inside a receiver portion 13 to receive a bottle 14 that constitutes an outer wall 14 or containment vessel 14 holding hydraulic oil.

The bottle 14 may be threadedly engaged, maintained by some other compressive force, clamped, or otherwise engaged with a cylinder 16 operating near the center of the bottle 14. Together, the bottle 14 and the cylinder 16 form an enclosed chamber. Of course, the receiver 13 of the base 12 secures the sealing of the bottle 14 and cylinder 16 against the base 12. The cylinder 16 and the bottle 14 in which it is disposed operate as fluid containers.

The bottle 14 actually maintains a comparatively low pressure, in fact, it need not support much greater than atmospheric pressure on a hot day. In contrast, the cylinder 16 will support hydraulic pressures of pumping, and will be the containment vessel 16 that entirely contains the pressurized supply of oil that actually will lift or be the main lifting element of the system 10.

In order to pressurize the cylinder 16, or the inside cavity thereof, a pump 18 may operate. A valve 19 alternately closes to permit flow from the pump 18 into the cylinder 16. It opens to provide relief of pressure out of the cylinder 16, passing oil from the cylinder 16 back into the bottle 14. Meanwhile, the pump 18 pumps oil out of the bottle 14 and into the cylinder 16, by increasing the pressure of the oil and lifting a piston 20.

The pump 18 is controlled in a certain context by the valve 19. In practice, if the valve 19 is opened into a first mode by an actuator 21, then the valve 19 passes all pressurized output from the pump 18 into the cylinder 16 below the piston 20. Thus, the pressurized hydraulic fluid lifts the piston 20 with respect to the cylinder 16. In a second mode, the valve 19 is set to release fluid out of the cylinder 16, passing it back into the bottle 14.

Thus, in mode one, the valve 19 is operated by an actuator 21 to move the valve 19 into mode one, pressurizing and holding the pressure in the cylinder 16 below the piston 20. Mode two is a release of pressure and hydraulic fluid from the cylinder 16, permitting descent of the piston 20 into the cylinder 16, lowering any load that is being supported thereon.

A system of check valves may exist between the valve 19, the cylinder 16 and the pump 18. In operation, the pump 18 needs to be able to draw oil at comparatively low (ambient) pressure from within the bottle 14 and pressurize it within its own cylinder 29 by actuation of the shaft 28 or piston 28 of the pump 18. However, that pressurized hydraulic oil needs to pass through a check valve such that the piston 20 cannot fall back into the cylinder 16, when the pressure dwindles, decays, or reverses from the pump 18. Thus, a one way check valve, as well understood in the art by that name, is placed in a line between the pump 18 and the cylinder 16. This assures that pressurized oil can only travel one direction, that is, from the pump 18 into the cylinder 16 below the piston 20 or main piston 20.

Upon release, the actuator 21 may be infinitely variable between the first and second positions in order to permit a comparatively slow descent of the piston 20 into the cylinder 16. Typically, with the actuator 21 in a position somewhere between the first and second positions, oil does not flow from the pump 18 into the cylinder 16, even if the handle 24 on the pump 18 is activated.

In that regard, the handle 24 is typically a lever 24 connected by a linkage 26 to an anchor 25 through several pivots 27*a*, 27*b*, 27*c*. Effectively, this assembly of components including the piston 28 or shaft 28 operates as a "four-bar linkage." This is a well defined mechanical mechanism understood in the mechanical engineering art. It is defined in any structural or design textbook for moving mechanical structures.

In operation, a system 10 in accordance with the invention may include an accessory 30 or a head 30. Herein, the head 30 of a system 10 is not the same as a head in a conventional jack. A conventional jack may have a shaft or lifting mechanism of some type, on which will be located a flat or textured surface for lifting. It is not improper to speak of that top lifting surface or structures immediately related thereto or adjacent thereto as the head of a jack, with the screw or shaft therebelow representing a shat.

However, herein, the head 30 is defined as an assembly made up of a yoke 32 provided with certain attributes. For example, a yoke 32 will typically include a retainer 34 on at least one extreme thereof. For example, a yoke 32 includes a lift surface 36. The lift surface 36 may be shaped to a particular desired contour to fit a specific shape or a specific range of objects to be lifted.

Between the lift surface 36 of a yoke 32 and a shaft 40 is a buttress 38 or buttressing material 38 that provides structural support and transfer of loading between the shaft 40 and the lift surface 36. Vertical loading passes to the lift surface 36 from a supported load. Load is the weight through a component on a vehicle (e.g., truck axle, leaf spring, other suspension component, flat axle, round axle, "U" bolt, or the like) that will be lifted by the yoke 32 atop the bottle jack 11.

The retainers 34 are not loaded vertically. The vertical load passes from the load to the yoke 32 by way of the lift surface 36, thence into the buttress 38, and ultimately into the piston 20 in the cylinder 16. A threaded shaft 40 transfers load through threads into the piston 20 or main piston 20 of the bottle jack 11. A smooth shaft carries no vertical load, but simply stabilizes the buttress 38, which does carry load. The threaded shaft 40 and smooth shaft are examples of lifting shafts configured to be connected to a jack head 30 such as those illustrated in FIG. 2 according to various embodiments. Lifting shafts may be implemented in various lengths having a wide variety of cross-sections. Typically, lifting shafts are made of metal (e.g., steel, iron or other metal known to those of ordinary skill in the art) and have a round cross-section and a length that exceeds its circumference.

As a practical matter, the retainers 34 may be symmetric with one another or not. In certain illustrated embodiments, the retainers 34 may be higher on one side (e.g., retainer 34*a*), and lower on the opposite side (e.g., retainer 34*b*). This resolves the difficulty of adjusting height of a main piston 20 and necessarily the head 30 to minimize the gap between the head 30 and the load before engaging the pump 18 to lift the piston 20.

Working underneath large vehicles, lateral registration presents a certain difficulty, often being not precisely determinable by vision. Thus, sliding a system 10 under an axle, leaf spring, "U" bolt, or the like, one may allow the lower retainer 34*b* to pass under the component that will eventually rest on the lift surface 36, relying on the taller retainer 34*a* to register the yoke 32, and head 30 generally, with respect to the lateral aspect of the lifted component. Nevertheless, the retainers 34 may be shaped, as may the lift surface 36 in a variety of embodiments as seen hereinafter.

In an apparatus 10 and method in accordance with the invention, blocking, cribbing, shimming, spacers, or the like may be placed under the base 12. However, the lower retainer 34*b* may be shorter or non existent, with respect to the higher retainer 34*a*. In this embodiment, the upper retainer 34*a* may be used to register the head 30 laterally with respect to the load to be lifted.

The contact between the upper retainer 34 may occur with respect to a loaded component while the lower retainer 34*b* actually passes under that component. Thereby, additional distance may be provided by way of altitude of the lift surface 36*b* before it engages the pump 18 to lift the piston 20.

The buttress 38 may be formed by any suitable process, including casting, forging, fabricating, cutting, and so forth. Thus, the strength of the buttress 38, and the overall strength of the yoke 32 and the head 30 generally may be improved by using worked metals, such as rolled steel for forming the yoke 32. Similar cast, forged, or worked materials such as rolled steel may be used for the shaft 40.

Typically, it will be an improvement to cut a slot in the shaft 40 in order for the shaft 40 to contain the yoke 32. Specifically, the buttress 38 will fit within a slot formed in the shaft 40. Nevertheless, this could be reversed. However, it has been found structurally that the size of a shaft 40 necessary to support a load, and to fit within the piston 20 of the bottle jack 11 represents a diameter greater than the thickness of the yoke 32. In fact, the shaft 40 may actually be hollow, representing a tubular structure sized to handle the loading in all dimensions that will be necessary for safety, suitable operation, long life, and so forth.

Cylindrical risers 42 may be used to adjust the height of the head 30 with respect to the piston 20. Each riser has a hole through its central axis shaped to receive a shaft 40. In conventional jacks, cribbing, spacers, blocking, platforms, or the like can adjust only the height of the base 12. Some conventional jacks do have a threaded shaft that threads in and out of an inside cavity of a piston 20 to adjust the initial height of the jack 11 before engaging the hydraulic mechanisms that lift the piston 20. This allows more efficient use of the very limited total distance of extension.

For example, any extension of a shaft 40 by threading it out of a piston 20 represents unloaded movement. This may be done without tools, with exertion of very little force. In contrast, once contact is made with the load, any lifting must be done by the hydraulic force from the pump 18 pressurizing hydraulic fluid under the main piston 20.

In certain embodiments of an apparatus 10 or system 10 in accordance with the invention, risers 42 may operate to uncouple the shaft 40 from vertical engagement with the interior of the piston 20. This provides certain benefits, and certain drawbacks. For example, having the head 30 immediately removable from within the piston 20 without tools is a convenience for changing out a head 30, selecting an appropriate head for the shape or location of a component to be lifted, and so forth. On the other hand, a conventional bottle jack is a self-contained apparatus. Only the handle 24 or lever 24 used to operate the pump 18 is even separable from the jack. Moreover, a tire iron (lug wrench) may be used as a handle for an extension for a comparatively short handle 24.

Several concepts for load paths will be discussed hereinbelow. They include threading the shaft 40, threading the interior of the piston 20, having either thereof threaded with the other smooth, or having both smooth. Thus, all combinations of threaded and smooth surfaces on the shaft 40 and piston 20 may be operable in a system 10 in accordance with the invention. Each provides different benefits, and poses different obstacles to implementation.

In various embodiments, risers 42 may provide spacing between the yoke 32 and the lifting end face of the piston 20. In fact, a significant advantage in a system 10 and method in accordance with the invention is the load path. Hydraulic oil inside the cylinder 16, is sealed below the piston 20 by a seal 20. The seal 20 typically moves with the piston 20. An 'O' ring near the top could work, but usually it is a seal 22 secured to the piston 20 and moving with the piston 20.

From that pressurized reservoir, the cylinder 16, the piston 20 is supported and lifted. It moves. Meanwhile, the load path does not pass between an interior surface of the piston 20 and an outer surface of the shaft 40. Instead, load passes from the top surface of the piston 20, an annulus to the yoke 32. It may pass through an intervening shim 42 or riser 42 that adjusts the initial height of the head 30 with respect to the jack 11.

Referring to FIGS. 2 through 10, while continuing to refer generally to FIGS. 1 through 12, one may see various embodiments for load transfer. In a conventional jack, having an adjustable shaft threaded with respect to a piston, the load path is carried by and includes threads. Thus, the load path is from the pressurized oil into the structure of the piston, then from threads on the piston into threads on the shaft, up the shaft, and into some lifting surface. Typically, the lifting surface is fixed with respect to a shaft, or is fixed with respect to the piston.

In contrast, the load path in a system 10 and method in accordance with the invention is from the oil into the structure of the piston 20. The load path goes directly through an upper, annular surface of the piston 20 to either the buttress 38 directly, or a shim 42. If a shim 42 is involved, then the shim 42 passes the load onto the buttress portion 38 of the yoke 32. In either event, the shaft 40 itself does not actually carry any vertical load. For all practical purposes, it acts as a lateral stabilizer to prevent movement of the yoke 32 in the horizontal direction with respect to the jack 11.

Figure 2:
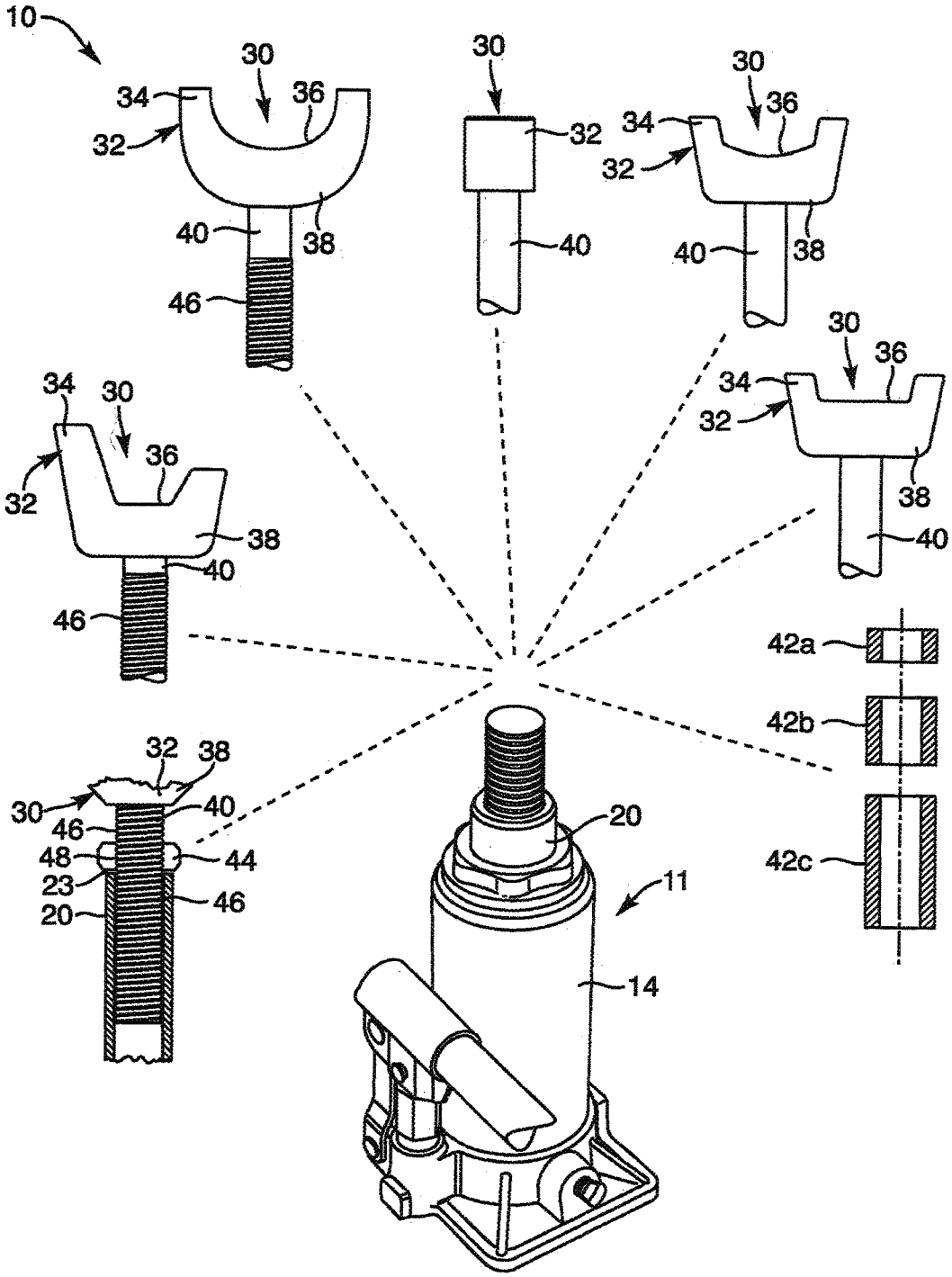
FIG. 2 is a perspective view of the system of FIG. 1 illustrating in side elevation profile views various alternative embodiments of various head systems identifying yokes, shafts, and risers in accordance with the invention.

Referring to FIG. 2, while continuing to refer generally to FIGS. 1 through 12, one may begin viewing alternative embodiments of heads 30 for the jack 11 clockwise from the extreme left. In the first embodiment, the shaft 40 is threaded to receive a collar 44 or ring 44. The collar 44 is threaded to spin up and down on the mutually engaged threads of the shaft 40 and collar 44. The threads 46 on the shaft 40 engage with the threads 48 on the collar 44 or ring 44. The collar 44 may be knurled, textured, fluted (having vertical ribs and intervening valleys for gripping), angled like a nut on a bolt, or the like.

The collar 44 without substantial frictional loads between itself and the upper annular surface 23 of the piston 20 turns comparatively freely. With proper tolerances and some modicum of lubrication, the collar 44 will rotate about the shaft 40, thereby advancing up and down the length of the shaft 40. In the illustrated embodiment, no engagement for vertical loading exists between the shaft 40 and the piston 20.

The piston 20 may be threaded with a thread size and inside diameter that simply do not fit threads on the shaft 40. In other embodiments, the internal surface of the piston 20 may be completely smooth. Thus, the shaft 40 is free to move vertically downward until the collar 44 is seated against the top surface 23 or annulus 23 of the piston 20.

Upon contact, the collar 44 now transfers loads through its threads 48 to the threads 46 on the shaft 40, thus supporting the shaft 40. The shaft 40 then transfers loading into the buttress 38 of the yoke 32. One will note that this view of the yoke 32 is cut away so that no retainers are shown. This is because an embodiment such as that shown may involve any set of retainers 34 discussed herein.

Moving to the next or second embodiment clockwise, the shaft 40 may be threaded along at least a portion of its length. In this embodiment, such a shaft 40 threads into a collar 44 or threads 48 on an inside surface of the piston 20. Thus, one may think of the threads 48 piston 20. The outside threads 46 are on a shaft 40. Thus, the second and third embodiments counter clockwise from the left both have threaded shafts 40, which may slip into smooth bores of pistons 20, engaged threads 48 on inside walls of a piston 20, or engage threads 48 of a collar 44. Meanwhile, the second and third embodiments clockwise from the left illustrate a flat or comparatively flat lifting surface 36, and a semi circular lifting surface 36, respectively.

Any yoke 32 may be secured to any type of shaft 40. In the fourth through sixth embodiments clockwise from the left, the shafts 40 are all shown as smooth. The difference between a smooth shaft and a threaded shaft is that a smooth shaft cannot engage threads for vertical loading. A threaded shaft 40 may engage threads for vertical loading, but need not do so.

Thus, the second and third embodiments may be rotated with respect to the piston 20 in order to provide initial height before engaging the pump 18 and lifting the piston 20. On the other hand, they need not engage other threads. The fourth through fifth embodiments, may accept threads. If remaining without threads 46 all must all register vertically by fitting against the top surface 23 of the piston 20 or the risers 42.

Meanwhile, the fourth embodiment shows a curved lifting surface 36, and retainers 34 of even length or matched lengths. The retainers 34 in this embodiment may also have offset lengths as in the second embodiment.

The fifth embodiment from the left is actually a cylindrical or cup shaped yoke 32 on a shaft 40. The shaft 40 may actually fit inside an inner diameter of a tubular yoke 32. A cavity above the shaft 40 and within the yoke 32 is sized to receive a "U" bolt. Meanwhile, the "U" bolt nut fits against the upper surface of the yoke 32, thus providing a convenient lifting location.

The sixth embodiment provides comparatively lower, typically even, retainers 34 restraining the lifted load and the yoke 32 with respect to one another. Thus, this head 30 need not rely on an exact fit, but simply provides some restraint against relative lateral motion occurring between the yoke 32 and the lifted load.

It has been found that a set of spacers 42 or risers 42 may be provided in the series of sizes. These may simply be based on individual units additive to one another. However, in one embodiment, one shim 42*a* may be one unit of height total, while another 42*b* is two units of height tall. A third 42*c* has four units of height. Thus, all combinations between one unit and seven units of height are available, in individual unit increments. A proper stack of one, two, or three at the spacers 42 goes on a shaft 40 before that shaft 40 is inserted into the piston 20.

Figure 3:
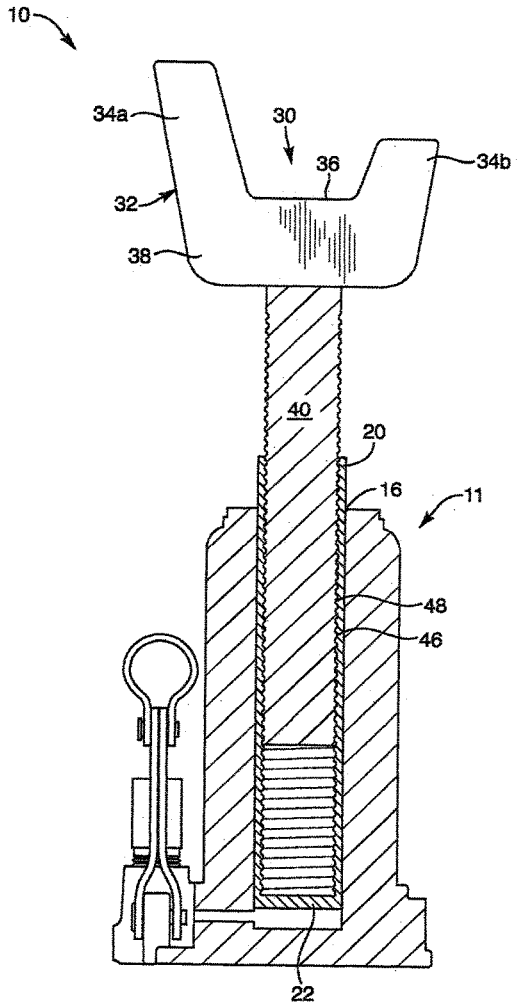
FIG. 3 is a side elevation view of one embodiment of a bottle jack including a threaded head cavity and threaded shaft in accordance with the invention.
Figure 4A:
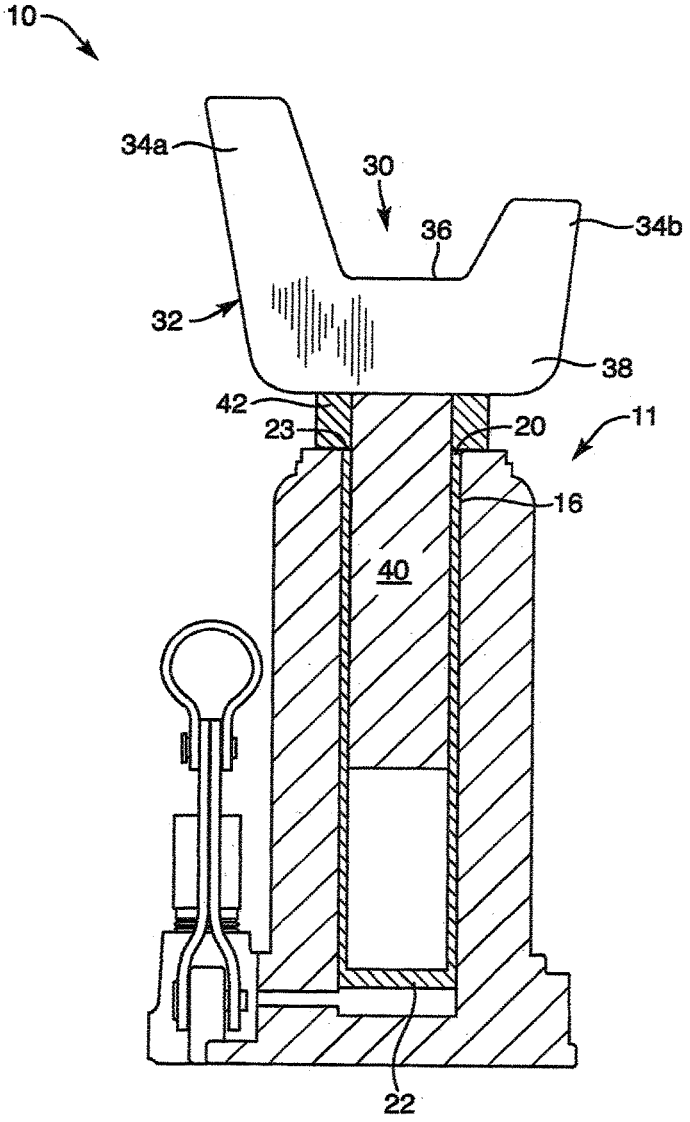
FIG. 4A is a side elevation view of an embodiment of a bottle jack system including a smooth head cavity and smooth shaft in the principal lift piston.
Figure 4B:
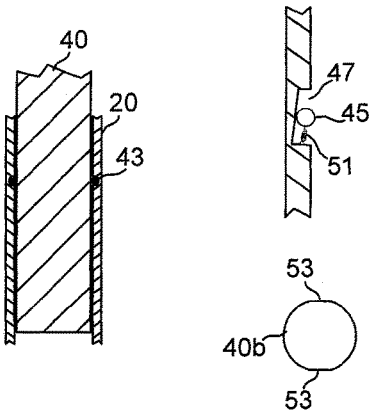
FIG. 4B is a cutaway view of a piston wall with an O-ring embedded and a cutaway piston wall with a mechanical keeper, according to various embodiments.

Referring to FIGS. 3 and 4A, while continuing to refer generally to FIGS. 1 through 12, a cutaway view illustrates how threads 46 on a shaft 40 may engage threads 48 on a piston 20. In this embodiment, load is transferred through the threads 46, 48 between the piston 20 and the shaft 40.

Thus, the buttress 38 below the support surface 36 or lifting surface 36 is supported by the shaft 40. The shaft 40 actually transfers load to the piston 20 or exchanges loading with the piston 20 through the threads 46, 48. Of course, as described hereinabove, relying on threads 46, 48 depend on their matching in pitch, size, diameter, and so forth. A smooth shaft 40 may be placed in a threaded head cavity of a piston 20. A threaded shaft 40 may be placed in a smooth head cavity of a piston 20. The head cavity is the hollow portion of the piston 20 that the shaft 40 of the jack head fits down within.

Referring to FIG. 4A, while continuing to refer generally to FIGS. 1 through 12, an embodiment having a smooth shaft 40 and a smooth interior surface of the piston 20 relies on the shaft 40 only for lateral support against tilting or shifting. Meanwhile, vertical loading occurs through the upper surface 23 of the piston 20 against either the buttress 38 of the yoke 32, or through the spacer 42. In some embodiments the shaft 40 is retained inside the piston 20 solely by gravity. In other embodiments a flexible collar such as O-ring 43 or other collar made of rubber or other flexible material may be fitted inside the piston 20 as shown in FIG. 4B to provide some friction for holding the shaft 40 within the piston 20 in addition to being held in by gravity. In other embodiments the shaft 40 may be held in place by a mechanical keeper such as a pin, a spring loaded 51 ball bearing 45 positioned in a slanted groove inside the piston 20, or other like type of mechanical structure for holding a shaft as are known by those of ordinary skill in the art. For those embodiments with a spring loaded 51 ball bearing 45 mechanical keeper the shaft 40 may have flat sides 53 or grooves that can be aligned with the spring loaded 51 ball bearing 45 mechanical keeper in order to remove the shaft 40.

Figure 5A:
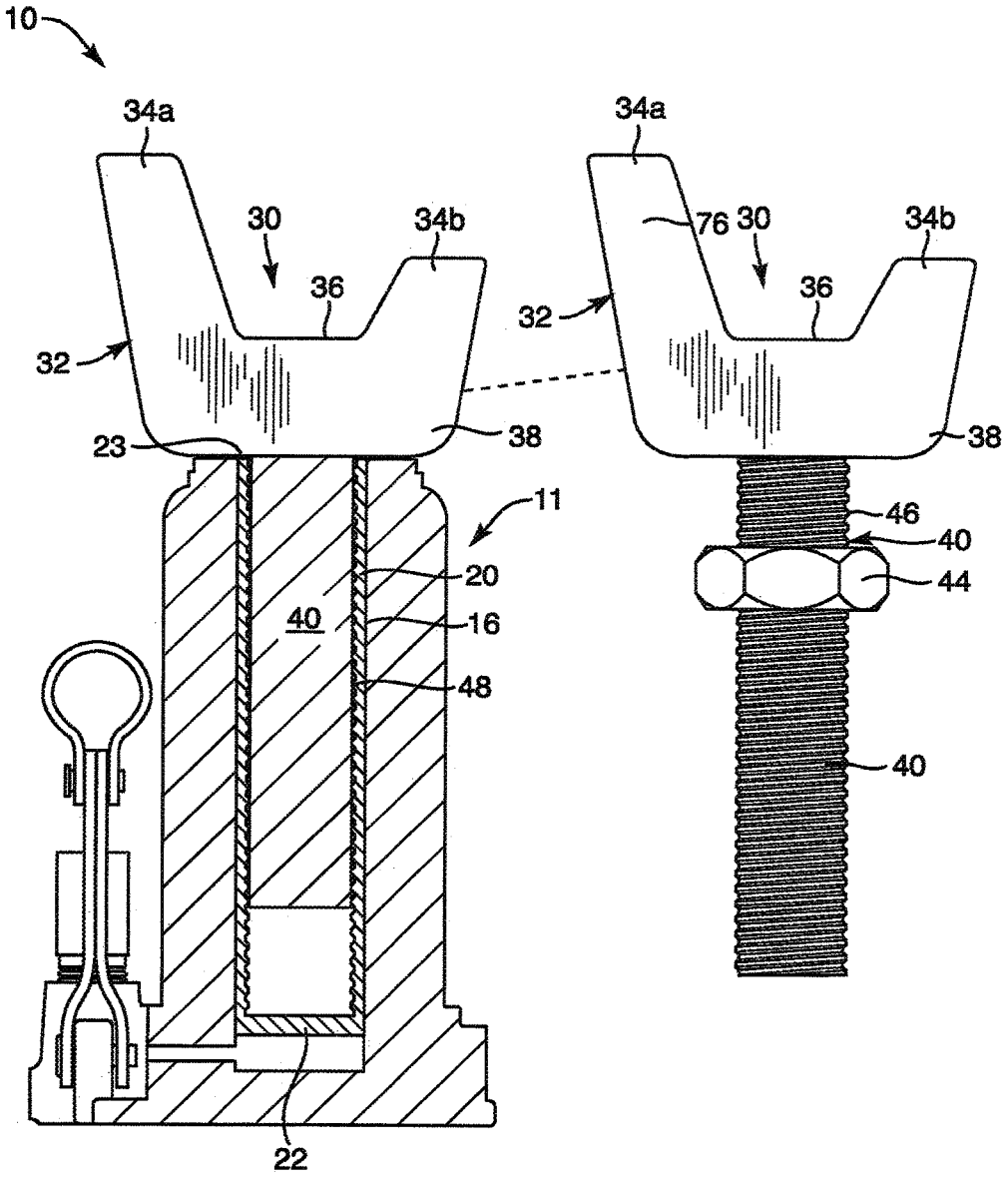
FIG. 5A is a side elevation view of an alternative embodiment of a bottle jack system having a non-engaging, threaded shaft that does not engage threads inside the lift piston of the bottle jack, regardless of whether they exist there, but which relies on an optional adjusting nut traversing up and down the threaded shaft to provide an initial offset of the head with respect to the piston.
Figure 7A:
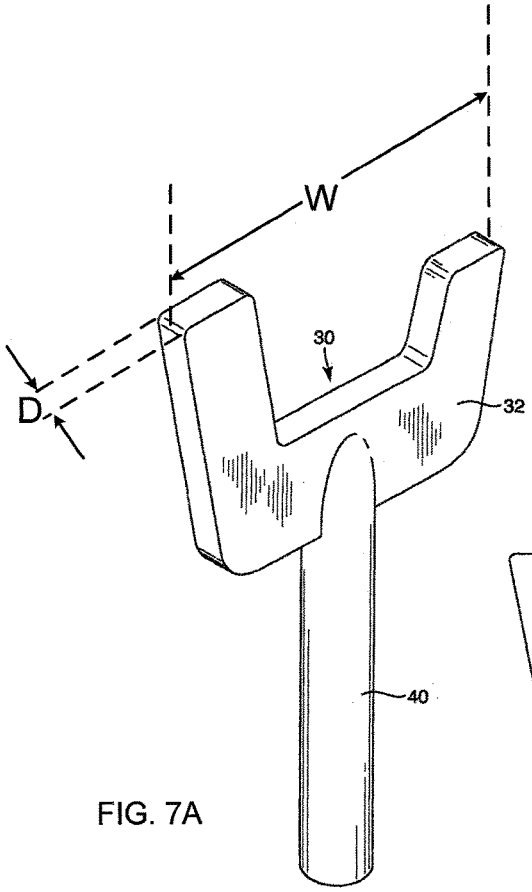
FIG. 7A is a perspective view of one alternative embodiment for a head system having a trapezoidal yoke on a shaft integrated therewith.

Referring to FIG. 5A, while continuing to refer generally to FIGS. 1 through 12, an example of a threaded interior head cavity of a piston 20 is simply bypassed, not supporting the shaft 40, because the shaft 40 is not threaded. In this embodiment, the top surface 23 of the piston 20 supports the yoke 32, or supports the yoke 32 on an intervening riser 42 or spacer 42.

FIG. 5B depicts a head 30 with a threaded shaft 40 similar to the head 30 shown in FIG. 3 and described above. A threaded bushing 31 is provided according to various embodiments with female threads that match the male threads of shaft 40. The piston 20*a* of FIG. 5B is bored out or otherwise formed to have a multi-diameter head cavity with smooth interior walls. By "smooth" it is meant that the interior walls of the piston 20*a* are non-threaded, that is, they do not have threads. The lower portion 20*d* of the multi-diameter head cavity in piston 20*a* in various embodiments has a smaller diameter than the upper portion 20*c*, leaving a shelf 20*b* at some point down within the piston's multi-diameter head cavity. The lower, smaller diameter portion 20*d* of the multi-diameter head cavity in piston 20*a* is of a sufficient diameter to accept the threaded shaft 40 of head 30. Since the walls of the lower head cavity portion 20*d* are not threaded they offer no vertical support to the threaded shaft 40 of the head. The upper, wider diameter portion 20*c* of the piston head cavity is of a sufficient diameter to accept the threaded bushing 31. The load path passes from shaft 40 of head 30 through the threaded bushing 31 and to piston 20*a* through shelf 20*b*.

The threaded bushing 31 may be screwed up and down the shaft 40 to adjust the height of the head 30 of the lifting device. In some situations it is useful to be able to adjust the head up and down without removing the bead from the piston head cavity to adjust the threaded bushing 31. To avoid having the threaded bushing 31 rotate along with the shaft (and thus not move up or down) a groove may be machined or otherwise formed around the circumference of the threaded bushing 31, with flexible collar such as an O-ring 33 or other flexible material fitted into the groove. The O-ring 33 protrudes outward from the grove by an amount that is sufficient to rub against the sides of the upper piston head cavity 20*c*. The frictional contact between the O-ring 33 and the upper head cavity wall 20*c* aids in preventing the threaded bushing 31 from rotating as the head 30 is turned to adjust the head up or down. This aids in keeping the threaded bushing stationary with respect to the piston 20*a* as the head 30 is being turned to adjust it up or down by threading the threaded collar 31 up or down its shaft. In other embodiments, the surface of shelf 20*b* and/or the bottom surface of threaded bushing 31 may be provided with a rough texture that aids in preventing threaded bushing 31 from rotating as the head 30 is turned to adjust the head up or down. Depending upon the requirements of the implementation the shelf 20*b* may be positioned at various heights along the piston head cavity. For example, the shelf 20*b* may be as high as 99% (towards the top) of the piston head cavity or as low as 10% (towards the bottom) of the piston head cavity.

Figure 6:
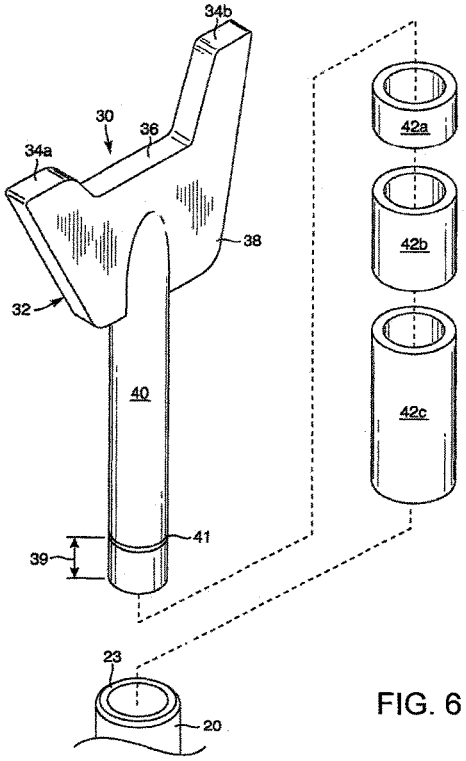
FIG. 6 is a side elevation view of a system of risers or shims adapted to fit over the shaft associated with the head of a bottle jack, and thus provide an initial displacement or offset of the shaft and yoke above the top of the main lift piston.
Figure 7B:
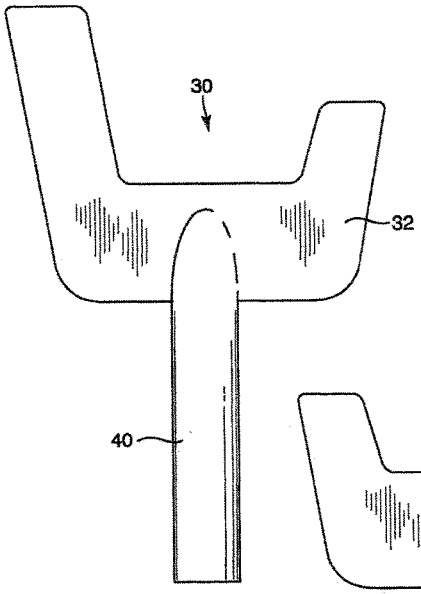
FIG. 7B is a front elevation view thereof.
Figure 7C:
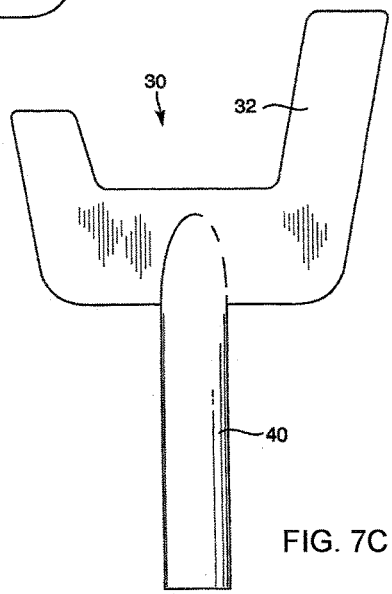
FIG. 7C is a rear elevation view thereof.
Figure 7D:
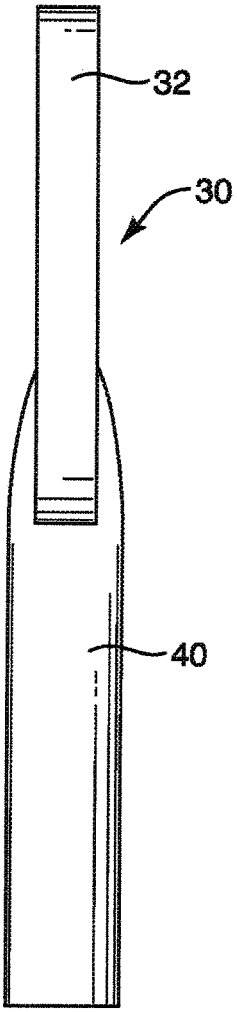
FIG. 7D is a left side elevation view thereof.
Figure 7E:
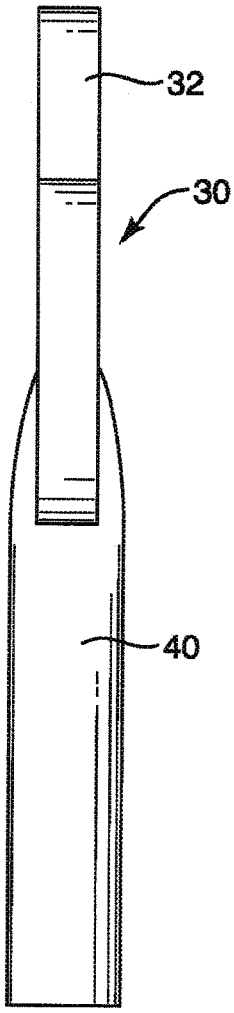
FIG. 7E is a right side elevation view thereof.
Figure 7F:
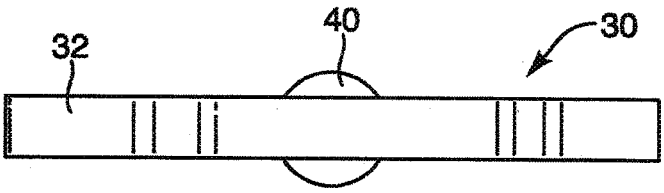
FIG. 7F is a top plan view thereof.
Figure 7G:
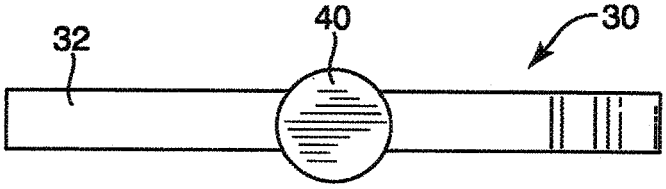
FIG. 7G is a bottom plan view thereof.
Figure 8A:
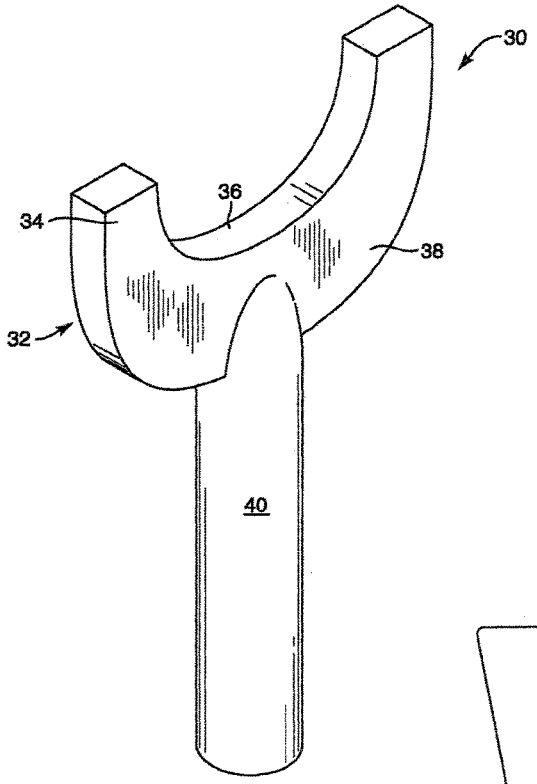
FIG. 8A is a perspective view of an alternative embodiment of a head system having a curved yoke integrated with a vertical shaft.
Figure 8B:
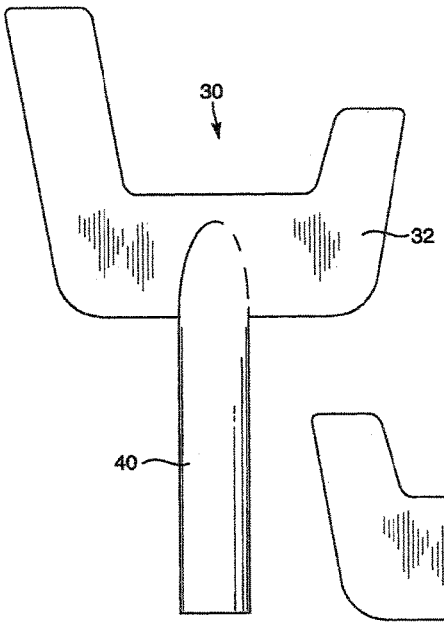
FIG. 8B is a front elevation view thereof.
Figure 8C:
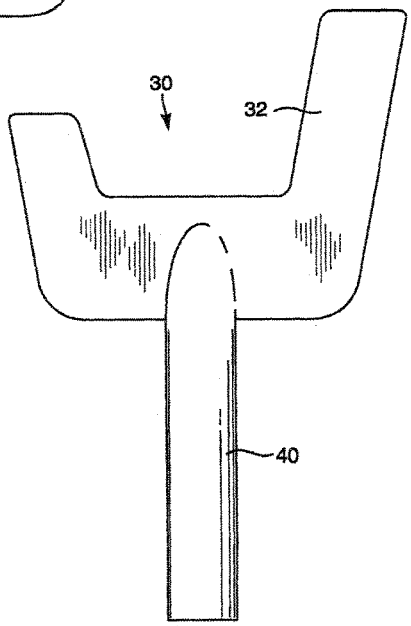
FIG. 8C is a rear elevation view thereof.
Figure 8D:
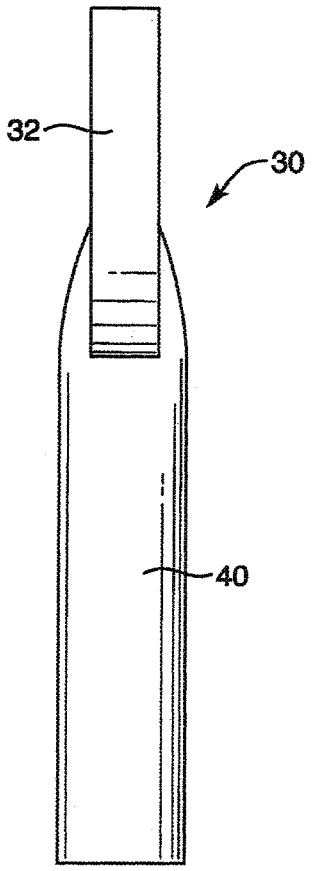
FIG. 8D is a left side elevation view thereof.
Figure 8E:
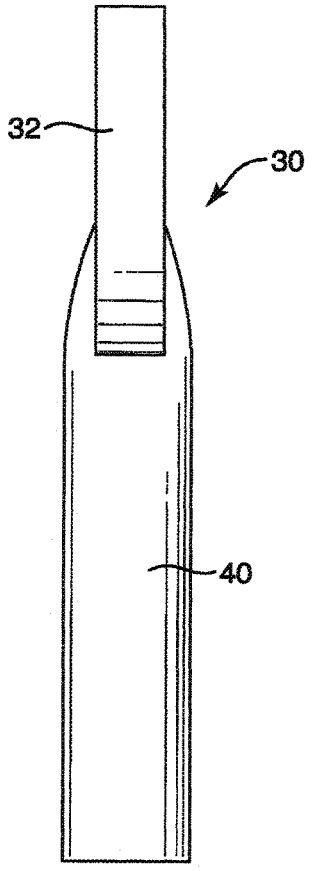
FIG. 8E is a right side elevation view thereof.
Figure 8F:
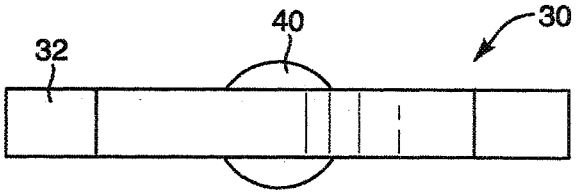
FIG. 8F is a top plan view thereof.
Figure 8G:
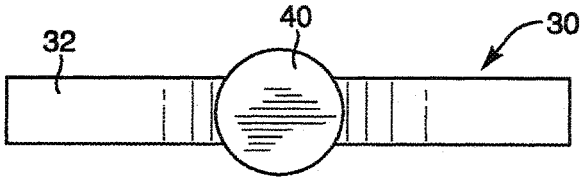
FIG. 8G is a bottom plan view thereof.

Referring to FIG. 6, in certain aspects of an apparatus and method in accordance with the invention, a shaft 40 may be provided with a head 30 formed in the shape of a yoke 32. The yoke 32 of head 30 is characterized by a yoke width W and a yoke depth D. In various embodiments the yoke width W is at least four times as long as the yoke depth D. The yoke 32 may be characterized by a lift surface 36 flanked on each extreme thereof (e.g., right end, left end, etc.) by retainers 34. In the illustrated embodiment, a first retainer 34*a* is shorter or lower, extending away from the shaft 40 less distance than does the upper or longer retainer 34*b*. The retainer 34*b* provides a registration aid 34*b* to position and orient a jack system 10 beneath a load, such as a trailer, truck, or the like.

One benefit to a system 10 in accordance with the invention is the ability to lift extremely heavy loads, over 10,000 pounds, and often involving axle of a heavy, over-the-road truck or its trailer at a remote location on a dark highway at an inconvenient hour, such as in the middle of the night. Such trucks may carry over 20,000 pounds of load. Of course the entire load is not a particular axle or a particular wheel. Nevertheless, once an axle is lifted to remove the tire from the ground (supporting surface), the jack is then supporting all load bearing on the lift point, typically a portion of the suspension (e.g., springs, shackles, U-bolts, etc.). by having a shaft 40 as a single element 40 rigidly welded or otherwise permanently and fixedly secured to the head 30, the shaft 40 provides a significant "bearing length." The principle of a bearing length is that every manufactured component or device has to have tolerances. If tolerances are too close, then fitting two parts together is a laborious careful process. If tolerances are too loose or relaxed, then slack, backlash, slop, tilting, movement, disorientation, and the like may result.

For example, a stack of checkers may be extended by addition of one checker at a time. However, without some type of engagement, the stack of checkers is very unstable. For this reason, checkers typically have an edge pattern of depressions and extensions that mate with one another to support against lateral movement of one checker with respect to another, once engaged.

Similarly, providing extensions constituting a shaft 40 in incremental pieces, each engaged by some engagement mechanism, such as pins, apertures, sockets, and stubs fitted to one another, or the like, provides a dilemma. Quick assembly and disassembly requires relaxed (large) tolerances. Stability requires close (small) tolerances.

By having a shaft 40 that is a single unit, the entire portion of the shaft 40 that sits within a cylinder 16 containing a piston 20 of a bottle jack 1 constitutes the bearing length. Accordingly, a comparatively larger bearing length may accommodate a relaxed tolerance making it easy to insert and remove a shaft 40 from inside the piston 20. The shaft 40 sits at least partially inside the piston 20. The piston 20 is driven by the pump 18 upward to extend out of the cylinder 16 containing the piston 20.

By placing a band 41 or mark 41 on the shaft 40 one may establish a bearing length 39 that will remain inside the piston 20 during operation and thereby provide stability against excessive tilting or other displacement or deflection of the shaft 40 with respect to the piston 20 and the bottle jack 11, generally.

In one embodiment, height adjustments to adjust the height of the head 30 above the upper surface 23 of the piston 20 may be done by risers 42, shims 42, or adjusters 42. These adjusters 42 may be formed as collars 42 or rings 42 acting to space the head 30 above the upper surface 23 of the piston 20. The spacers 42 may be added in suitable increments.

In contrast to the shaft 40 with its threads 46 in FIG. 5A, the spacers 42 (e.g., 42*a*, 42*b*, 42*c*) are not fixedly engaged to the shaft 40. For example, the collar 44 is threaded to travel along the threads 46, and thus fix the position of the collar 44 with respect to the shaft 40, thereby establishing a bearing length 39 below the collar 44, and an extension length above the collar 44 (closest to the head 30).

In the embodiment of FIG. 6, in contrast, the spacers 42 are free to move with respect to the shaft 40, but are restrained by the head 30 thereabove, and the upper surface 23 of the piston 20 therebelow. For example, a user may invert the shaft 40 in space, drop one or more spacers 42 onto the bottom end of the shaft 40, and then place the bottom end of the upright shaft 40 into the piston 20. The shaft 40 will sink into the piston 20 until the top surface 23 contacts and stops the spacers 42, with the spacer 42 being driven downward by the weight or force of the head 30 and shaft 40. Thus, the head 30 and shaft 40 are stably supported by the piston 20 in the bottle jack 11.

In the illustrated embodiment, the spacers 42*a*, 42*b*, 42*c* may be of different sizes (lengths). For example, if the spacer 42*a* is one unit of some length dimension in height, then the spacer 42*b* may be two units high. Similarly, the spacer 42*c* may be four units (increments) of distance in total height. Accordingly, combinations of zero space between the head 30 and the top surface 23, one unit increment, two increments, three increments, four increments and so forth up to seven unit increments are all available by various combinations of the spacers 42. Thus, all lengths from zero to seven in discrete increments of one single unit of height (length) may be available.

In some respects, a system 10 in accordance with the invention is considerably more complex than a conventional, inseparable system and requires more sophistication for use. However, a system 10 in accordance with the invention is designed to support large loads, typically vehicles having a gross vehicle weight (GVW) greater than about 9,000 pounds. This includes, typically, common carriers used for over-the-road transport. Semi tractor trailer rigs are typically a dominant population in such vehicles.

On a dark night, underneath a large trailer on a remote roadway, a mechanic or technician can set a bottle jack 11 underneath a lifting point selected on a vehicle. Estimating the approximate height of the lifting point above the bottle jack 1, and specifically above the upper surface 23 of the piston 20, the user may select a particular head 30 on its shaft 40 of suitable length (height) and some combination of spacers 42.

Dropping the spacers 42 onto the shaft 40 in the upside down position, the technician is warned by the marker 41 against leaving less than a minimum bearing length 39. Holding the bottom end of the shaft 40 will maintain the comparatively lightweight (compared to the shaft 40 and head 30) spacers 42 on the shaft 40 while the bottom end of the shaft 40 is inserted into the piston 20.

A user may now slide the bottle jack 11 more-or-less horizontally along the supporting surface until the high retainer 34*b* registers against the components about the lift point on the vehicle. For example, the retainer 34*b* may strike the side of an axle, the side of a spring, the side of a shackle, or the like. Thus, the lift surface 36 is in position to be elevated by operation of the pump 18 lifting the piston 20 to make contact between the lifting point (surface, etc.) and the contact surface 36 or lifting surface 36.

The high retainer 34*b* provides registration and prevents the head 30 from slipping out from under the lift point or lift region once lifting has begun. It is well known that jacks may tilt as a swing arm, anchoring a lift point to a frame of a vehicle, will swing in an arc as the suspension system is compressed with the added weight or force locally imposed by the jack. This places more of the load of the vehicle on that particular area of the suspension system.

Thus, the retainer 34*b* permits a user to rely on contact and physical engagement to register (e.g., align, fit, contact, position, fix, etc.) the head 30 horizontally (e.g., along the ground or road) with respect to the lift point or lift region, knowing affirmatively where the head 30 is located. Otherwise, a user may have to rely on eyesight, which may not even be possible. For example, in darkness, with lift points behind other equipment or components, and so forth, a user can set the head 30 by feel, knowing that the retainer 34*b* has struck and registered with a side of a component near, or part of, the lift point (usually a contact region above the head 30) that will contact the necessary lift surface 36 of the head 30.

Referring to FIG. 7A through FIG. 7G, while continuing to refer generally to FIGS. 1 through 12, in certain embodiments, a design is shown in particular detail for a head 30, in accordance with the invention, having a yoke 32 with retainers 34 that are not symmetric. This embodiment uses a flat lift surface 36, and illustrates a smooth shaft 40.

Referring to FIGS. 8A through 8E, an alternative embodiment of a head 30 in accordance with the invention may rely on a semicircular lift surface 36, whether or not that surface actually covers an entire semicircle. However, many large vehicles (e.g., trailers) have tubular axles. Accordingly, capture of those axles and lifting thereof in a semi circular yoke 32 may be advantageous. As with FIGS. 7A through 7G, the shaft 40 illustrated is shown as smooth, but need not be so in all embodiments.

Nevertheless, as described hereinabove, all embodiments may rely on a threaded shaft 40, a smooth shaft 40, or the like. This simply changes the operational method and the load path. Of course, such changes still require the alternative load path, which is not supported by conventional systems. By use of a head 30 in accordance with the invention, certain conventional systems may be converted to operate with a head 30 in a retrofit manner.

For example, in certain embodiments, a conventional jack may be dismantled, by forcing the shaft threads to distort sufficiently or deflect sufficiently. This deflection may be plastic (yielding), elastic (temporary), or a combination. A shaft 40 may be threaded out from an internal thread on the hydraulic piston 20. In such a manner, the shaft 40 may be damaged, but is no longer necessary. It may be replaced with a head 30 on a shaft 40 in accordance with the invention having a smooth shaft 40, a threaded shaft 40, or the like, fitted inside the piston 20.

One advantage to having a smooth shaft 40, making the load path not pass through shared threading between a shaft 40 and a piston 20, is that the yoke 32 may be rotated to slip readily under a loading location (lift point), such as an axle, leaf spring, "U" bolt, spring shackle, or the like. Thus, it is a convenience to be able to rotate the shaft 40 readily within the piston 20 without changing elevation, or without requiring a change in elevation.

For example, a coupling may be built to permit rotation of a head 30, yoke 32, or both with respect to a shaft 40. However, replacing fixed junction or weld between a yoke 32 and a shaft 40 with a rotary joint causes difficulties with stress (force per area), strain (stretch or shrinkage), yielding (failure, plasticity), misalignment, galling (surface abrasion), stability, and so forth. Moreover, the load path from the shaft 40 through the yoke 32 into the lift point or lift region of the load may become weakened by that rotating joint. Nevertheless, such may be provided and may be thought of as a rotary joint replacing the weld between a shaft 40 and its yoke 32.

Certain inconveniences are added compared to conventional bottle jacks. For example, the unitary self containment is lost. However, in certain situations, most particularly commercial repair services for large over-the-road trucks, the safety of bottle jacks is constantly in question. Uneven terrain on which to set the jack, difficulty in line-of-sight positioning, mismatched surfaces between the top surface of a jack and the bottom surface of a lifting location on the vehicle, horizontal shifting of a lift point as it rises, and so forth all conspire to render field use of a conventional bottle jack dangerous. A smooth, flat floor of a shop or garage, with the neat, specialized floor jacks and trolley jacks on precise steel wheels are not a practical option "on the road."

In contrast, here, a yoke 32 in accordance with the invention may stabilize the bottle jack 11 with respect to the lifted load, capturing on any of the illustrated lift surfaces 36 the appropriate surface of a lift location. Thus, for example, a circular axle will engage with substantial lateral stability a system as in FIG. 8 (where FIG. 8 refers to the FIGS. 8A through 8E). likewise, other custom shapes may be used.

Figure 9A:
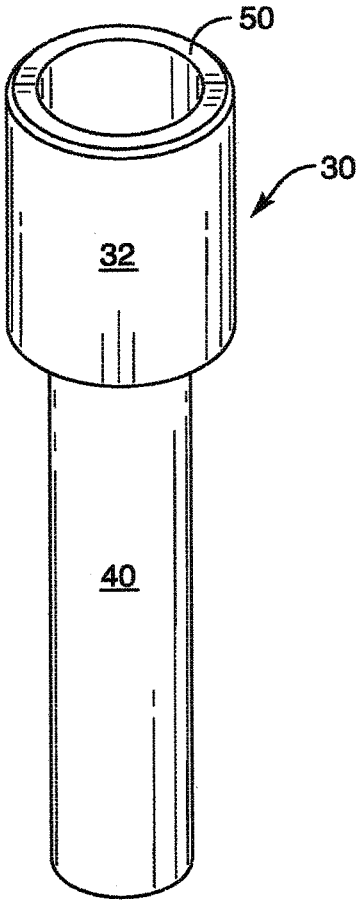
FIG. 9A is a perspective view of an alternative embodiment of a head system for a bottle jack in accordance with the invention having a cup or cylinder shape for a yoke integrated with a shaft.
Figure 9B:
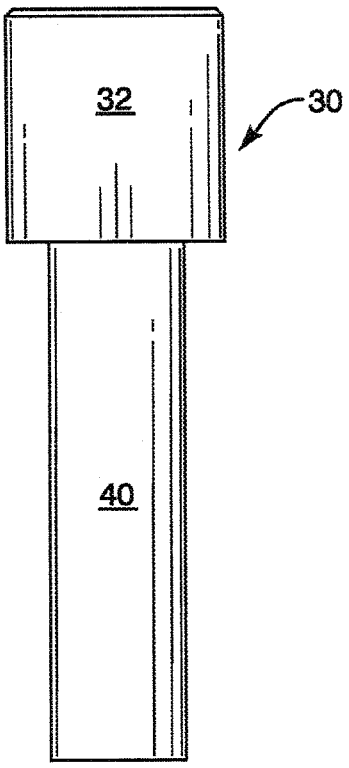
FIG. 9B is a front elevation view thereof, the rear elevation view, the left side elevation view, and the right side elevation view all being identical thereto.
Figure 9C:
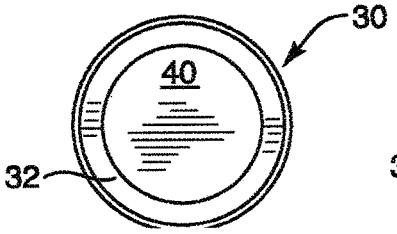
FIG. 9C is a top plan view thereof.
Figure 9D:
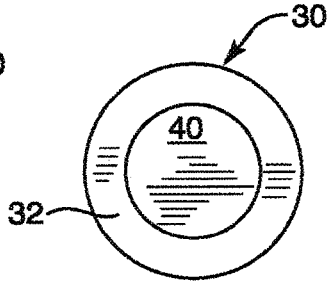
FIG. 9D is a bottom plan view thereof.

Referring to FIGS. 9A through 9B, various views show a head 30 having a yoke 32 constituted by a tubular member or cup welded or otherwise secured to a shaft 40. Each is sized to receive the extension of a "U" bolt protruding through the nut capturing that "U" bolt about an axle and spring assembly. Here, the upper surface 50 of the yoke 32 is effectively an annulus. Meanwhile, the bottom thereof may fit on top of the annular surface 23 at the top of a piston 20. Thus, the load path (the mechanical regions through which force and stress are transferred between the ground and the vehicle frame that is supported by the suspension) is well supported, and the shaft 40 operates simply to orient the yoke 32 with respect to the piston 20.

Figure 10A:
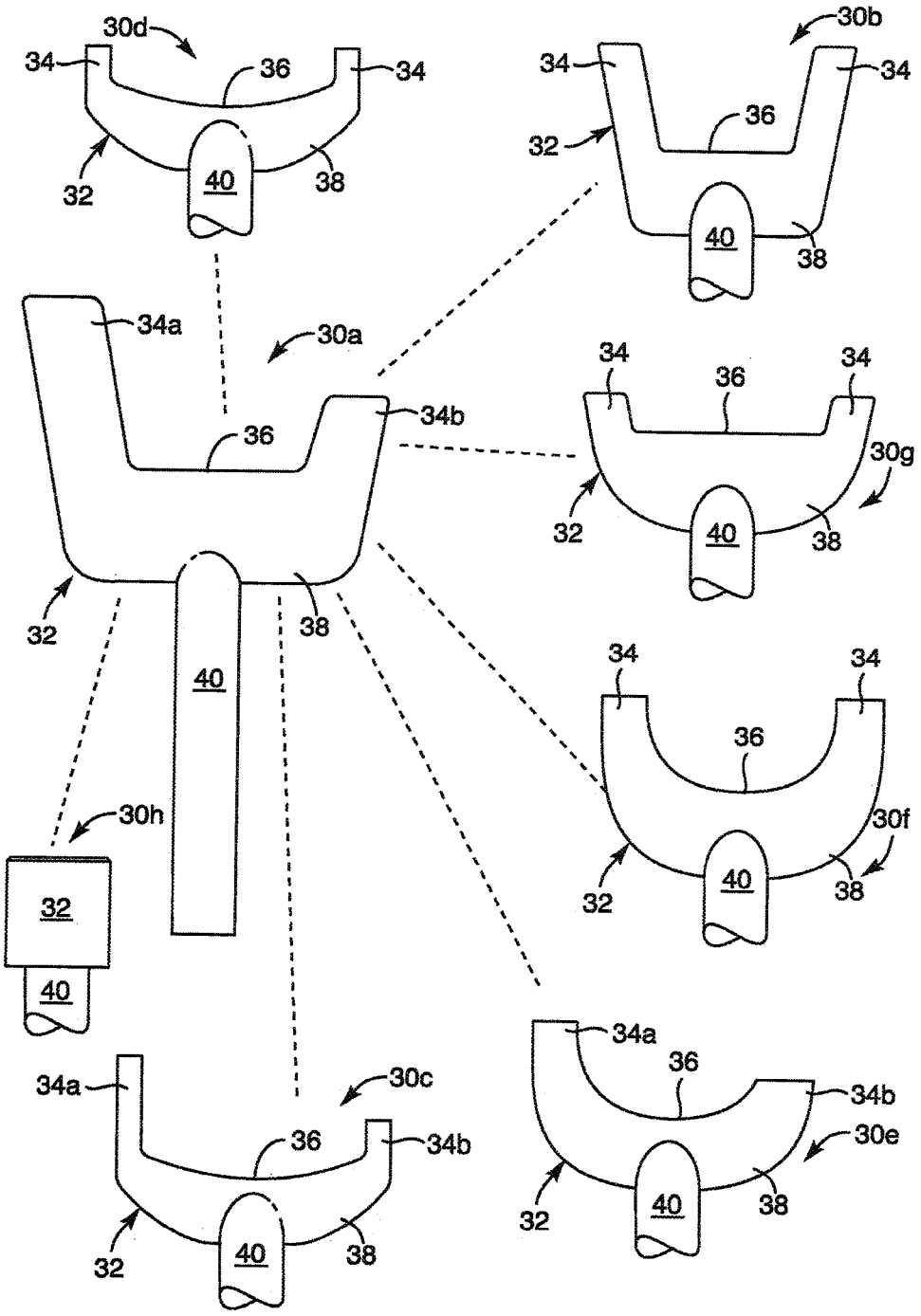
FIG. 10A is a side elevation view of one embodiment of a head system having various shapes for the yoke portion integrated to a shaft portion of an accessory for use in a bottle jack in accordance with the invention.

Referring to FIG. 10A, while continuing to refer generally to FIGS. 1 through 12, the profiles of the various embodiments are illustrated. Beginning clockwise from the lower left, a typical shaft 40 may support a yoke 32 of a size and shape selected to match a particular component that will be used as the lift location by a commercial operator.

For example, a tire shop or repair truck may carry a kit comprising one or more of the illustrated embodiments of heads 30 and several jacks 11I. Each of the heads 30 includes a yoke 32 and shaft 40. Each of these heads 30 may be adapted to the use to which it will be put. The embodiments of heads 30*a*, 30*c*, and 30*e* have a high retainer 34*a* and a low retainer 34*b* described hereinabove. Meanwhile, the heads 30*b*, 30*d*, 30*f*. 30*g*, and 30*h* represent some longer or comparatively shorter retainers 34. The head 30*d* has a yoke 32 with a rather elongate curvature on the lifting surface 36. The surface 36 may be semicircular, but is not matched to actually accept a full semicircle between the retainers 34.

Many axles are substantially rectangular in cross section, but may have a certain curvature due to their engineered design or manner of forming, such as forging, casting, and the like. Meanwhile, curved axles that have a smaller diameter than the effective diameter of the lifting surface 36 may also rest on the lifting surface 36.

Meanwhile, the comparatively longer retainers 34 of the heads 30*b* and 30*f* are even and symmetrical with respect to one another. Similarly, shorter symmetric retainers 34 in the head 30*d* forfeit some of the ease of horizontal registration before engagement with a lift point. The semicircular embodiment 30*f* with symmetric retainers 34 is formed continuously and contiguously with a buttress 38 to form the semi circular lifting surface 36.

Any of these embodiments may lift a circular or a rectangular cross section and maintain it between the appropriate retainers 34. However, selecting a shape for the lift surface 36 that matches most closely the lift point (region) on the load provides significant safety through resistance against slipping, sliding, or horizontal movement that may result in tipping a jack 11 on its side or otherwise shifting it or kicking it out of place.

One will note that the sixth embodiment clockwise provides a semi circular form of the lifting surface 36, having non symmetric or disparate heights between the retainers 34. Again, the tubular or cup-shaped yoke 32 is the seventh clockwise embodiment. The shafts 40 are cut away here indicating that any of these shafts 40 may be any of the shafts 40 identified hereinabove.

Thus, load paths that engage threads to threads or smooth to smooth may be used. Load paths that ignore threads present and use threads adjacent to smooth surfaces to provide lateral alignment and stability without vertical load lifting may also be embodied. The threaded and smooth surfaces may exist on the shaft 40, on the interior surface of the piston 20, both, or neither.

In certain embodiments of an apparatus 10 or system 10 in accordance with the invention, one may adjust the top height a bottle jack 11 in accordance with the invention by using blocking, cribbing, spacers, shimming, or the like below the base 12. Meanwhile, trimming up the position of the lift surface 36 of the head 30 below the lifting location may be done by any of several methods described hereinabove. Meanwhile, the shaft 40 may typically be longer in a system 10 in accordance with the invention than a conventional shaft.

Conventional shafts have many limitations on them, not the least of which is column buckling, possible bending, and the like. Moreover, shear strength, failure, or damage to threads will limit the extension that such a shaft may have outside of a piston. In contrast, in a system 10 and method in accordance with the invention, a longer shaft 40 may consume any part or all of the length inside a main piston 20. Thus, a longer bearing length (in engineering parlance, this expression refers to the maximum dimension between points at which an extended member is "supported" when loaded, and thereby provides additional stability or leverage with a longer bearing length than is provided with a shorter bearing length) provides additional stability and strength.

Safety may be somewhat enhanced by a smooth shaft that does not operate on the mere engagement of a few threads that may fail, causing injury, damage, death, or any combination thereof. Thus, one may think of the spacers 42 as providing pre-adjustment or trimming of the initial or starting position that a head 30 occupies. Particularly a mechanic usually want any lift surface 36 to be in a position as close as possible to a lift point under a lifted load prior to operating the pump 18 to extend the piston 20 of the bottle jack 11. One desires to take up any gap therebetween to leave a maximum extension effect for the piston 20.

It may be required in certain embodiments to lose "infinitely variable" pre-adjustment available in an integrated system. It is contemplated that in its most robust or adaptable form, a system 10 in accordance with the invention will lose the convenient, integrated construction of conventional bottle jacks. This provides to a skilled commercial user a universal system 10 that can safely handle various shapes, sizes, heights, and locations as described hereinabove, of lifting points on a vehicle or other load, with the same bottle jack 11 without precarious tilting, for example. Thus, a certain amount of compactness of fully integrated construction is lost, in favor of more safety and adaptability. The goals of improved performance, substantially increased safety, and more operator discretion result for the head 30 under the load. Loads are easily registered horizontally, laterally engaged against slipping out from engagement, and affirmatively captured during all lifting.

A system 10 in accordance with the invention may still use for blocking or shimming below and trimming above prior to loading. This provides a longer effective throw or lift distance for the head 30 on or in the piston 20 and for the jack 11, generally. A longer shaft 40 in accordance with the invention provides addition bearing length to resist tilt, yielding, popping out of the piston 20, or to accommodate coarse tolerances on sizes.

For example, in many embodiments, of vehicles, the suspension systems are such that upon lifting away from the road surface or underlying earth surface, the lifting surface 36 may move, or the lift location may move in an arc. Accordingly, the jack 11 may be forced to tip. In such an embodiment, the retainers 34 may assist in maintaining alignment, and permit the jack 11 to actually tilt somewhat, while not risking the load slipping out of engagement therewith.

In other embodiments, until loads are maximized, a jack 11 may slide along the set of cribbing or other spacing therebelow in order to track the load being lifted and its particular position. Meanwhile, the bearing length of the shaft 40 within the piston 20 permits much higher trim distances without sacrificing the lateral stability of the shaft 40 in the piston 20 or with respect to the remainder of the jack 11.

This provides yet another benefit in accordance with the invention. Various heads 30 may have different lengths and shafts 40. For example, there are no fundamental reasons why a shaft 40 may not be many times longer (with or without spacers 42) than a conventional shaft on a jack, and thereby provide an extension away from the piston 20 by the head 30 all within the head 30 itself. This provides a much simpler method of use, more stability, and less danger than conventional jacks of many varieties.

Moreover, the attachments 30 or heads 30 in accordance with the invention can be sized to fit any particular inner diameter and annulus 23 of any particular piston 20. Thus, the piston 20 may have its size dictated strictly by axial loading, and not by thread loading. Thus, so long as the piston 20 and shaft 40 are configured to resist failure under axial load, under column buckling modes, these may be sized to support substantially larger loads than might otherwise be carried thereby.

Thus, simpler methods of use, self centering, stability, capture of the lifted load, better functioning, even if the base 12 does tilt somewhat with respect to the horizontal dimension, and so forth all provide a useful kit as either an add-on accessory 30 the head 30 alone or as a system 11 built as a production unit. Meanwhile, jacks 11 may be built with individual yokes 32 as shown, or to quickly receive, use, and remove any particular head 30 with its particular shape of yoke 32.

Figure 10B:
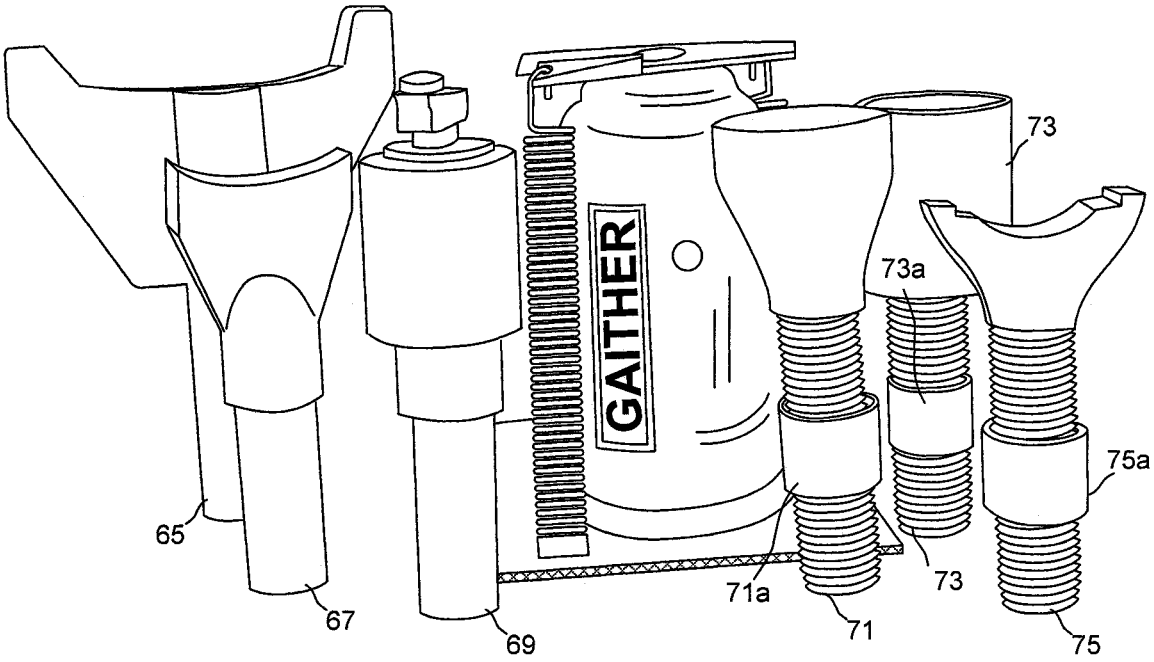
FIG. 10B depicts six implementations of lifting heads according to various embodiments.

FIG. 10B depicts six implementations of lifting heads according to various embodiments. Lifting head 65 has a symmetrical yoke with retainers that are approximately 1 inch tall of equal height. Lifting head 67 also has a symmetrical yoke with a lifting surface that is slightly concaved. Lifting heads 65-69 each have smooth, non-threaded shafts. Lifting heads 67 and 69 each have a multi-diameter shaft. Lifting heads 71-75 each have threaded shafts. Lifting heads 71-75 are each depicted with a threaded bushings 71*a*-75*a* removably attached to each respective one. The threaded bushings 71*a*-75*a*, when used in conjunction with a lifting member having a multi-diameter cavity, allow the height of the jack head to be adjusted up or down, as described in further detail above in conjunction with FIG. 5B.

Figure 11:
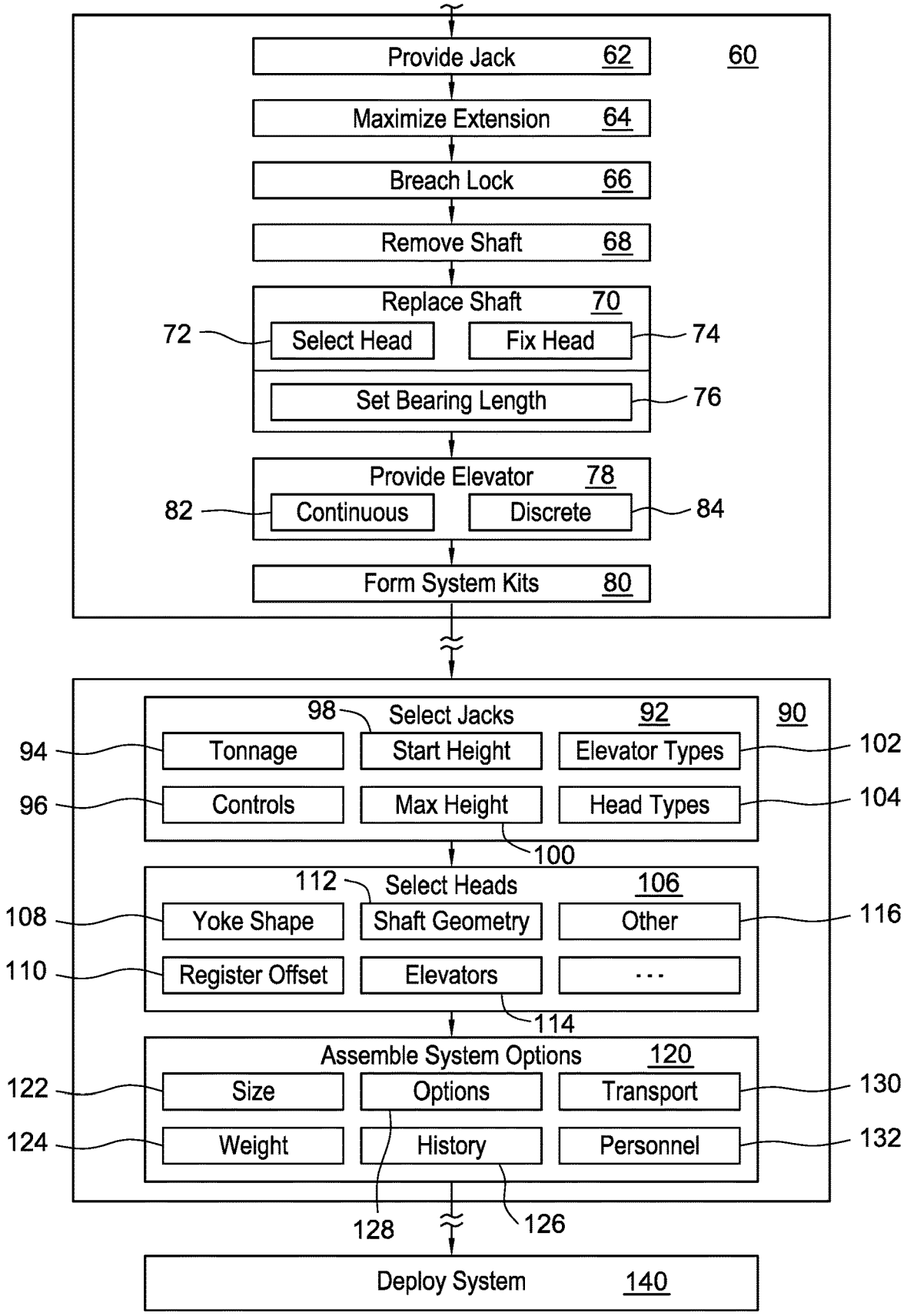
FIG. 11 is a schematic block diagram of a process for manufacturing a bottle jack in accordance with the invention, including an optional retrofit embodiment, as well as a process for outfitting a service truck or other operation.

Referring to FIG. 11, a method 60 is provided for creating a system 10 in accordance with the invention. Providing 62 a jack, particularly a bottle jack 11, may be done by manufacturing a bottle jack 11 to order as discussed hereinabove or by converting a bottle jack 11 originating with some other supplier. The details of bottle jacks and how they work are well understood, and sufficiently details are discussed hereinabove.

In one method 60 one may provide 62 a bottle jack 11 by purchasing a conventional bottle jack, of conventional design, and maximizing 64 the extension of the shaft 40 within the piston 20. This will involve rotating the shaft 40 until the shaft 40 can rotate no longer within the piston 20. At that point, one must fix the piston 20, against rotation, if it does not have such a mechanism already built into the bottle jack 11.

Thereafter, one must forcibly rotate the shaft 40 such that it yields, deflects, or otherwise breaches 66 the locking mechanism that prevents over extension of the shaft 40 in the piston 20. Typically, one or more of the lowest threads 48 on the shaft 40 may have been yielded by a punch, press, or the like in order to misalign them, making them not match and not pass through the threads 48 of the piston 20. By forcing the shaft 40 to overextend, the locking element has been forced (yielded, failed, deflected, or all thereof) and thereby breached 66. Thereafter, the shaft 40 may be further rotated in order to remove 68 the shaft 40 from the piston 20.

The steps 64, 66, 68 may be considered optional. That is, for example, steps 64 through 68 are a mechanism or method central to retrofitting a conventional jack. Thus, since a conventional bottle jack 11 is not manufactured to receive a smooth shaft 40 as illustrated in FIGS. 6 through 10, or a threaded and collared shaft 40 as illustrated in FIG. 5A, then it may be retrofitted with such.

Next, one may replace 70 or place 70 a shaft 40. This replacement step 70 may include selecting 72 a head, fixing 74 (e.g., welding) a head 30, actually the yoke 32, to a shaft 40, and setting 76 a bearing length 39. Setting 76 a bearing length 39 may involve setting the entire length of the shaft 40 by selecting such a shaft, selecting its diameter, and so forth. Thus, replacing 70 a shaft 40 will necessarily include selecting a shaft 40, and selecting a head 30 shape or yoke 32 to be welded or otherwise fixed thereto.

Providing 78 an elevator may involve the addition of either a collar 44 on the threads 46 of a threaded shaft 40, or selecting a set of spacers 42 to be fitted on a smooth shaft 40. Of course, the spacers 42 may also be used on a threaded shaft 46, but mechanically a smooth shaft 40 will necessarily be stronger, stiffer, and provide less chance of interference between threads 46 on the shaft 40 that are with the threads 48 that may be left or may remain inside the piston 20 in a retrofit embodiment.

Providing 78 an elevator may involve the selection and fabrication 82 of a continuous elevator 44 (such as the collar 44), or selection and creation 84 of a discrete elevator 42 (shim 42, adjusters 42, etc.), such as the spacers 42*a*, 42*b*. 42*c*, and so forth. Providing 82 a continuous collar type elevator 44 provides finer adjustments. Providing 84 a discrete elevator 42 (shim/adjuster 42) allows for faster but discrete adjustment of height. Limited, discrete, extension heights may be selected to be available for elevating the head 30 above the piston 20.

Forming 80 kits may involve assembling one or more jacks, one or more heads, fixed in advance to their shafts, as well as elevating members 42, 44. For example, a kit may include several heads 30 of different types including several heads of the same type on various shafts 40, corresponding thereto, having various lengths. Similarly, a suitable number of spacers 42 may be provided. The illustrated embodiment of FIG. 6 shows a system of three spacers 42, but any number of spacers 42 may be used, with different incrementing schemes.

For example, a "base-two" length system may simply add spacers 42, each twice the size of the next lower. Other embodiments may choose particularly useful lengths for the spacers 42 according to typical heights of axles, spring shackles, springs, U-bolts, U-bolt plates, and so forth. U-bolt plates are located near the threaded ends of U-bolts, and are the plates against which the nut is tightened on a U-bolt thread.

Also, forming 80 kits may involve selection of any number of yoke 32 defining the heads 30. For example, a user may desire to have multiple cup-shaped yokes 32 for heads 30 (see FIGS. 9A through 9D), of different diameters, and having different shafts 40 of different lengths. Similarly, a user may have preferences as to shapes of yokes 32 for heads 30, including flat, semicircular, or the like lift surfaces 36. Similarly, a choice of height of the long retainer 34*a*, or the presence of a long retainer 34*a* at all, may be a choice. Ultimately, a kit containing a system 10 will be formed 80 for sale or use.

A method 90 for setting up a service truck may include selecting 92 one or more jacks 11. Selections may be based, for example, on tonnage 94 or lifting capacity 94, the controls 96 or control system 96 including hydraulic oil supply, pumping system, power supply, lifting and descending controls 96, and the like. Similarly, one may select a start height 98 for a piston 20, as well as a maximum height 100 for the piston 20, head 30, and shaft 40 supporting a yoke 32, at the maximum height of the lifting surface 36. Elevator types 102 may be selected 102 along with head types 104 as described hereinabove. Various shapes, options, sizes, thicknesses, and so forth, as well as the fundamental geometries may be selected 102, 104 for the elevator 102 and head types 104. Herein, the blocks of the schematic illustration represent both the hardware, and the selection or creation thereof.

Selecting 106 heads 30 may involve selecting and creating 108 the shape of the yoke 32 that forms the head 30, creating 110 the register offset relating the relative distance between the lift surface 36 and the registration retainer 34*b*. Likewise, the shaft geometry 112 may be round, smooth, threaded, hexagonal, rectangular, or of some other shape. Accordingly, selection 112 of a shaft 40 geometry may be done in conjunction with elevators 42 selected 114 for that particular shaft geometry 112.

Other factors 116 may be considered or designed in selecting 106 or otherwise providing 106 a head. Thus, the process 90 may then proceed to assembling 120 a system 10 for a service truck according to the available options. A user may assemble 120 a system 10 according to considerations of size 122, weight 124, various operational options 126, and history 128.

For example, as with most operations, the operational options 126 may be informed by history 128 of a user. Accordingly, certain sizes, weights, head (yoke 32) types 104, elevator 42 types 102, and the like as well as maximum heights 100 may be more useful than others. Accordingly, a system 10 may be assembled 120 to make it more useful while being lighter or smaller, or not. Thus, transport 130 and operating personnel 132, including their personal preferences may influence the assembly 120 of a system 10 based on the available options. Thereafter, having a system 10 available, the system 10 may be deployed 140 on demand.

Figure 12:
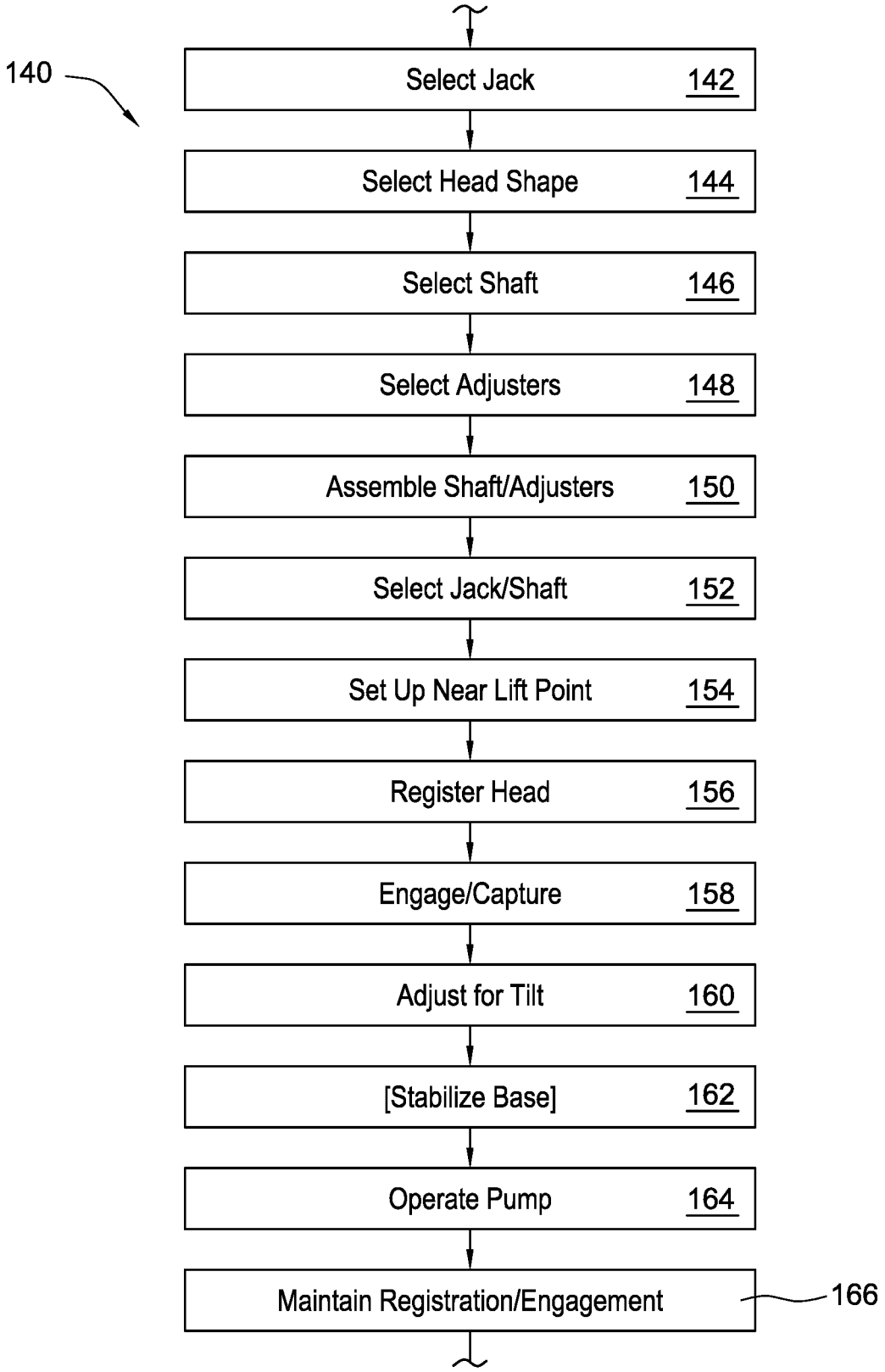
FIG. 12 is a schematic block diagram of one embodiment of a method for using a bottle jack in accordance with the invention.

Referring to FIG. 12, while continuing to refer generally to FIGS. 1 through 12, the actual method 140 of use may involve selecting 142 a jack 11, selecting 144 a head 30 shape (yoke 32 shape), which will be fixed to a particular shaft 40 selected 146. Thus, selecting 144 a head 30 and selecting 146 a shaft 40 involve selecting a unit that includes the desired yoke 32 and shaft 40. Selecting 148 adjusters 42, 44 or elevators 42, 44 may be included with or likewise depend on the pre-configured shape and operational characteristics of the shaft 40 selected 146 fixed to a yoke 32.

With a jack 11 and the shaft 40 and adjusters 42, 44 selected 146, 148, one may assemble 150 the adjusters 42, 44 on the shaft 40. Thereafter, the shaft 40 may be assembled 152 into the jack 11, and particularly into the piston 20. One may set up 154 the jack 11 on a roadway (supporting surface) near a lift point. This may be done by physically moving the jack 11 under the lift point, with the assembled 150, 152 system 10 as a unit 10.

The shaft 40 may be extended by elevating the piston 20 a suitable distance at which the lower retainer 34*b* will clear the lift point, and the longer or higher retainer 34*a* will not. The jack 11 may then be moved by sliding horizontally along the supporting surface until the higher restraint 34*b* contacts a structure, thereby aligning the lifting surface 36 with the lift point or lift surface 36. Such a registration 156 of the head 30 may be done by pushing or sliding the system 10 away from a user toward the lift point, or by drawing the system 10 toward the user from an opposite side of the lift point.

A user may select the method by which visibility will be improved, or touch and sound are relied upon as an aid, building confidence that a well aligned registration 156 may be assured. After registering 156 in a lateral or horizontal direction the head 30, one my engage 158 or capture 158 the lift point within the yoke 32 bounded by the retainers 34*a*, 34*b*. At this time, the piston 20 may be brought up so that the lifting surface 36 contacts the lift point, or short of that, so that the retainers 34*a*, 34*b* restrain lateral motion, or horizontal motion nominally, but yet permit further sliding of the base 12 of the bottle jack 11.

In this way, one may adjust 160 the position of the bottle jack 11 for tilt. This may involve actually tilting the jack 11 in some circumstances. It may simply involve sliding horizontal (nominally) on the supporting surface (road, road bed, etc.), or may involve actually tilting the jack 11. If the bottle jack 11 is actually tilted, then stabilizing 162 the base 12 may involve shimming the base such as by placing thin wedges to accommodate the flat base 12 on the bottle jack 11 to any misalignment with the underlying supporting surface or road base. Operating 164 the pump 18 will now elevate the head 30, making contact between the lifting surface 36 and the lift point or lift area of the vehicle being lifted. Meanwhile, the retainers 34*a*, 34*b* maintain 166 registration and engagement of the lift surface 36 with the yoke 32.

A system in accordance with the invention provides a stable platform and a stable shaft 40, with no balancing act required to keep a lifting point fixed in relation to the yoke 32 of the head 30. Instead, a retainer 34*a* registers (aligns) the lifting surface 36 under a desired lifting point. Spacers 42 or elevators 42 are stable in use on a shaft 40, yet easily and quickly removed or added, rather than requiring slow turning of threads.

Safety against disengagement of the shaft 40 from inside the piston 20 is provided by markings 41 establishing a bearing length 39 therebelow. Tolerances may be determined along with the bearing length to assure stability and rigid body movement of the piston 20 and head 30 together.

The yoke 32 will register the jack 11, which can be moved horizontally on its base 12 by simply releasing lift pressure enough to provided working space to slide the jack 11 while the retainers 34 remain engaged, even when the lift surface 36 is not loaded or even in contact with the lift point. After any such adjustment, lifting can begin again.

Tilting of the jack 11 after a load has been lifted partway may be ameliorated by shimming with blocks or wedges, for stabilizing "purchase" of the base 12 on the supporting surface. The top of he head is unaffected, and the piston 20 need not be released to descend. Instead, the yoke 32 remains engaged throughout, capturing the component on which the lifting point (usually a lifting area) is found.

Creating a system 10 may be done by retrofitting a conventional jack after extracting the factory installed shaft contained therein. Alternatively a separable-component-bottle-jack may be fabricated in which the head 30, with its solid shaft 40 and yoke 32 as an integral unit 40, is separated or assembled with the piston 20 of the jack 11 at will, rapidly, and without tools.

Meanwhile, the entire head 30 can be turned at will if not loaded (load being a force or pressure applied, usually by an object having weight). Thus rapid positioning of a yoke is available in four degrees of freedom (e.g., height or elevation, rotation, horizontal left/right or forward/backward under a vehicle) to fit under a bracket, leaf spring, spring shackle, axle. U-bolt or other location on a suspension system. Registration (horizontal alignment by contacting a component) is easily done, even without clear sight.

No double jacking (using one jack, setting a fixed block or holder, dropping the jack head, putting more blocks under the jack after moving the jack location, lifting again, repeating, etc.) can be done away with. Shifting by jacks during a lift, and calculating risks of loads falling caused thereby, can largely be eliminated. No unique training or retraining on the use of some new jack is required. The shaft 40 simply slides in and out of the piston 20 instead of threading. Elevation offset or pre-set height can still rely on blocks below, but can elevation (spacing) may be done continuously or discretely.

In some embodiments, a component such as an axle can slide along a flat lift surface 36, yet remain captured by the retainers 34, with little or no risk of danger from excessing tipping, or sliding off the head 30, because of the shape of the yoke 32. Thus motion that might otherwise urge tipping is accommodated with no shift in the jack 11.

The shaft 40 may be tapered at the bottom end to pilot quickly into the piston 20. Changing out heads 30 is quick and easy, with only the weight of the head 30 and spacers 42 being lifted in and out as the jack 11 stays on the ground.

The O-ring used in various embodiments, for example, O-rings 33 and 43, may be made from various materials and have a number of different cross-sectional profiles (as viewed if the strand of the O-ring is cut through). For example, the O-rings may be made from rubber, silicon, plastic, or any other like type of flexible material known to those of ordinary skill in the art. The O-rings may have a cross-sectional profile that is round, oval, rectangular, triangular or other cross-sectional shapes known to those of ordinary skill in the art.

Figure 13:
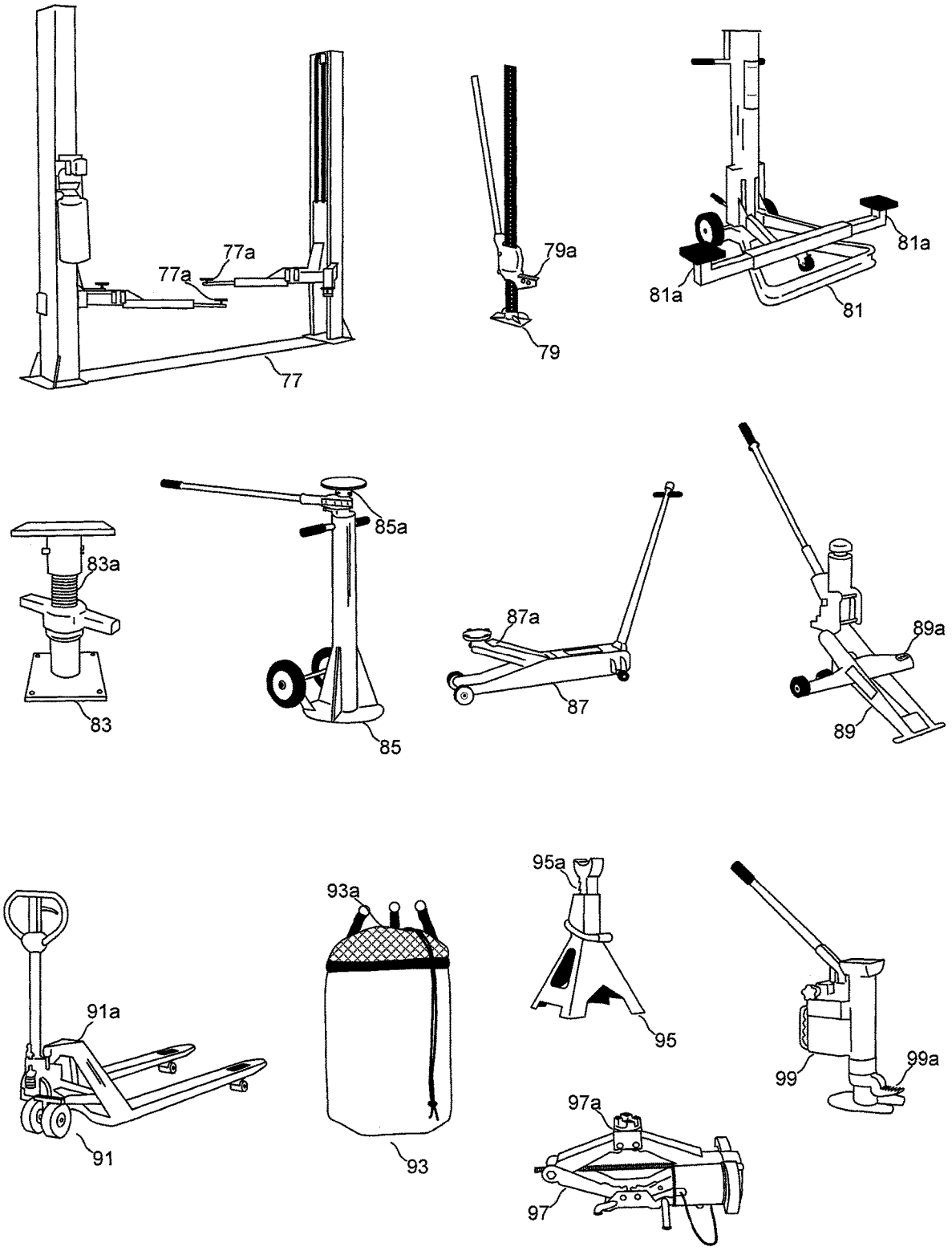
FIG. 13 depicts a number of different types of lifting devices suitable for use with the various embodiments.

FIG. 13 depicts a number of different types of lifting devices suitable for use with the various embodiments. For example, the various embodiments of a lifting head disclosed herein may be used in conjunction with a multi-post overhead lift 77 (e.g., two-post overhead lift, four-post overhead lift, etc.), a farm jack 79, a bumper jack 81, a screw jack 83, a trailer jack 85, a floor jack 87, a forklift jack 89, a pallet jack 91, a lifting bag 93, a jack stand 95, a scissors jack 97 and a toe jack 99. Each of the various types of lifting devices 77-99 has one or more lifting members 77*a*-99*a* that can be controlled to move up and down to lift various sorts of objects. For example, as a user twists the handle of screw jack 83 the threaded lifting member 83*a* of the screw jack moves up or down. Similarly, as a user pumps the handle of floor jack 87 the lifting arm 87*a*-*a* lifting member-moves up or down to lift or lower an object such as an automobile. The various embodiments disclosed herein may be implemented with other types of lifting devices not depicted in FIG. 13 that are known to those of ordinary skill in the art.

The terms "up," "upward," "down" and "downward" are used throughout this disclosure to aid in describing and explaining the various embodiments. These terms are to be taken relative to the pull of gravity towards the center of the earth. For example, upward is a direction pointing directly away from the center of the earth. The term "horizontal" is a direction orthogonal to upward/downward. If "horizontal" is used to describe a part or line on a device, it implies a direction of the part or line for the device sitting in its normal or intended state—for example, a bottle jack sitting upright with its base resting on a flat floor. The term "vertical" is used to describe a direction orthogonal to horizontal. The term "slightly less than" is defined to mean "at least 90% of". For example, the diameter of a threaded bushing that is slightly less than the piston cavity diameter is at least 90% of the piston cavity diameter. The term "approximately" as used herein means plus or minus as much as 5%. For example, a first component that is approximately the same length as a second component is within +/−5% of the second component's length. The term "removably attached" is used herein the mean that two parts (or components, elements, etc.) are attached to each other, but may be unattached without destroying or damaging either part. A nut can be removably attached to a bolt. But two metal parts welded on to each other are not said to be removably attached.

The present invention may be embodied in other specific forms without departing from its purposes, functions, structures, or operational characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

The invention claimed is:

1. An apparatus configured for use with a lifting device that includes a lifting member with a head cavity, the apparatus comprising:

a lifting head configured to at least partially fit within the head cavity of the lifting member, wherein the head cavity is a multi-diameter head cavity with an upper portion characterized by an upper wide diameter and lower portion characterized by a lower narrow diameter;

a lifting shaft configured as part of the lifting head, the lifting shaft having a round shaped cross-section and a length that exceeds its circumference, the lifting shaft being configured to fit at least partially within the head cavity and extend out of the head cavity in an upward direction;

a yoke configured as part of the lifting head and connected to the lifting shaft, the yoke having a yoke width and a yoke depth, the yoke width being at least four times as long as the yoke depth; and a threaded bushing with an outside diameter slightly less than the upper wide diameter and wider than the lower narrow diameter;

wherein the lifting shaft is retained at least partially within the head cavity by gravity, and is removable from the head cavity without tools, a load path passing from the lifting shaft to the lifting member.

2. The apparatus of claim 1, wherein the lifting device has an O-ring fitted around the inside of the head cavity to aid in retaining the lifting shaft within the head cavity.

3. The apparatus of claim 1, further comprising:

one or more cylindrical risers each with a central axis hole shaped to receive the lifting shaft.

4. The apparatus of claim 3, wherein the one or more risers is a plurality of risers;

wherein the plurality of risers are configured to stack on each other with the lifting shaft extending upward from the lifting device through the central axis hole of each of the plurality of risers; and wherein the lifting member is controllable by a user to move up and down.

5. The apparatus of claim 1, wherein the threaded bushing has a groove around its outer circumference, the apparatus further comprising:

a flexible collar with an inside diameter slightly less than the outside diameter of the thread bushing, the flexible collar being configured to fit within the groove.

6. The apparatus of claim 5, wherein, upon the threaded bushing being inserted into the head cavity, the flexible collar contacts side walls of the upper portion of the head cavity to aid in keeping the flexible collar stationary with respect to the lifting member.

7. The apparatus of claim 1, wherein the lifting device is a bottle jack and the lifting member is a piston, the bottle jack comprising:

a base;

a containment vessel sealed to the base;

a cylinder within the containment vessel;

a pump connected between the cylinder and the containment vessel;

a system of valves controlling movement of hydraulic fluid between the containment vessel, the pump, and the cylinder; and a shoulder configured as part of the lifting head, the shoulder being positionable in direct contact with an annulus.

8. The apparatus of claim 1, wherein the lifting device is a type selected from the group consisting of a multi-post overhead lift, a farm jack, a bumper jack, a screw jack, a trailer jack, a floor jack, a forklift jack, a pallet jack, a lifting bag, a jack stand, a scissors jack and a toe jack.

9. A method of manufacturing a lifting apparatus having a head cavity formed within a lifting member, the method comprising:

providing a lifting head configured to at least partially fit within the head cavity of the lifting device, wherein the head cavity is a multi-diameter head cavity with an upper portion characterized by an upper wide diameter and lower portion characterized by a lower narrow diameter;

providing a threaded bushing with an outside diameter slightly less than the upper wide diameter and wider than the lower narrow diameter;

providing a lifting shaft configured as part of the lifting head, the lifting shaft having a round shaped cross-section and a length that exceeds its circumference, the lifting shaft being configured to fit at least partially within the head cavity extending upward out of the head cavity in an upward direction; and providing a yoke configured as part of the lifting head and connected to the lifting shaft, the yoke having a yoke width and a yoke depth, the yoke width being at least four times as long as the yoke depth;

wherein the lifting shaft is retained at least partially within the head cavity by gravity, and is removable from the head cavity without tools, a load path passing from the lifting shaft to the lifting member; and wherein the lifting member is controllable by a user to move up and down.

10. The method of claim 9, further comprising:

fitting an O-ring fitted around the inside of the head cavity of the lifting device to aid in retaining the lifting shaft within the head cavity.

11. The method of claim 9, further comprising:

providing a plurality of cylindrical risers each with a central axis hole shaped to receive the lifting shaft;

wherein the plurality of risers are configured to stack on each other with the lifting shaft extending upward from the lifting device through the central axis hole of each of the plurality of risers.

12. The method of claim 9, wherein the threaded bushing has a groove around its outer circumference, the method further comprising:

providing a flexible collar with an inside diameter slightly less than the outside diameter of the thread bushing, the flexible collar being configured to fit within the groove.

13. The method of claim 12, wherein, upon the threaded bushing being inserted into the head cavity, the flexible collar contacts side walls of the upper portion of the head cavity to aid in keeping the flexible collar stationary with respect to the lifting member.

14. The method of claim 9, wherein the lifting device is a type selected from the group consisting of a multi-post overhead lift, a farm jack, a bumper jack, a screw jack, a trailer jack, a floor jack, a forklift jack, a pallet jack, a lifting bag, a jack stand, a scissors jack and a toe jack.

* * * * *